US012564768B1

(12) United States Patent
Stroud

(10) Patent No.: US 12,564,768 B1
(45) Date of Patent: Mar. 3, 2026

(54) GOLF BALL WITH ELECTRICAL COMPONENTS

(71) Applicant: Topgolf International, Inc., Dallas, TX (US)

(72) Inventor: Ethan D. Stroud, Liberty Hill, TX (US)

(73) Assignee: Topgolf International, Inc., Dallas, TX (US)

( * ) Notice: Subject to any disclaimer, the term of this patent is extended or adjusted under 35 U.S.C. 154(b) by 329 days.

(21) Appl. No.: 18/243,494

(22) Filed: Sep. 7, 2023

Related U.S. Application Data

(60) Provisional application No. 63/406,641, filed on Sep. 14, 2022.

(51) Int. Cl.
*A63B 67/02* (2006.01)
*A63B 24/00* (2006.01)
*A63B 37/00* (2006.01)
*A63B 43/00* (2006.01)

(52) U.S. Cl.
CPC ..... *A63B 43/004* (2013.01); *A63B 24/0021* (2013.01); *A63B 37/0076* (2013.01); *A63B 2024/0034* (2013.01); *A63B 2220/35* (2013.01); *A63B 2225/54* (2013.01)

(58) Field of Classification Search
CPC ..... A63B 43/004; A63B 24/0021; A63B 37/0076; A63B 2024/0034; A63B 2220/35; A63B 2225/54
USPC ..... 473/324–330
See application file for complete search history.

(56) References Cited

U.S. PATENT DOCUMENTS 6,093,923 A * 7/2000 Vock ..... G01S 3/7864 250/206.1
10,493,329 B1 * 12/2019 Luciano, Jr. ..... A63B 37/0003
10,688,366 B1 * 6/2020 Petrich ..... A63B 37/0051
10,751,575 B2 * 8/2020 Komatsu ..... A63B 37/00921
11,344,784 B1 * 5/2022 Dykhuis ..... A63B 37/0076
2003/0216228 A1 * 11/2003 Rast ..... A63B 47/021 482/84
2005/0064950 A1 * 3/2005 Carter ..... A63B 69/3655 473/280
2007/0173349 A1 * 7/2007 Eng ..... A63B 37/0003 473/570
2008/0045358 A1 * 2/2008 VanDelden ..... A63B 69/3658 473/409
2009/0003136 A1 * 1/2009 Karr ..... A63B 24/0021 367/128
2009/0040761 A1 * 2/2009 Huang ..... A63B 43/06 362/253
2010/0056302 A1 * 3/2010 Cheng ..... A63B 37/0003 473/376
2013/0234304 A1 * 9/2013 Tamaki ..... H01L 23/66 257/659
2018/0214758 A1 * 8/2018 Mosher ..... A63B 69/3655
2019/0224552 A1 * 7/2019 Kiraly ..... A63B 24/0021
2021/0113892 A1 * 4/2021 Eberle ..... A63B 37/0054
2021/0325426 A1 * 10/2021 Onuki ..... G01P 3/48
(Continued)

*Primary Examiner* — Michael A Cuff
(74) *Attorney, Agent, or Firm* — Michael A. Catania

(57) ABSTRACT

A golf ball comprising piezoelectric material and a wireless transmitter is disclosed herein. The golf ball also comprises at least one of an integrated circuit having a gyroscope, a magnetometer, and a BLUETOOTH low energy (BTLE) radio, and at least one battery.

1 Claim, 27 Drawing Sheets

(56) References Cited

U.S. PATENT DOCUMENTS

| | | | | |
|---|---|---|---|---|
| 2022/0069927 | A1* | 3/2022 | Abdelmonem ..... | H04B 1/1027 |
| 2022/0336942 | A1* | 10/2022 | Lim ..... | H01Q 1/2283 |

* cited by examiner

GOLF BALL WITH ELECTRICAL COMPONENTS

CROSS REFERENCES TO RELATED APPLICATIONS

The Present Application claims priority to U.S. Provisional patent Application No. 63/406,641, filed on Sep. 14, 2022, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to golf balls. Particularly to golf balls with internal electronics.

Description of the Related Art

Most patents that have been filed looking at communicating between a ball and a device involve only trying to find the golf ball using RFID type circuitry. Most of the designs will only be successful in getting a user close to the position of the golf ball.

TOPGOLF's RFID ball, used for the Topgolf game system, can only identify a ball, and is not a solution that can provide any valuable information about the state/location of the golf ball.

However, a RFID solution does not provide location information of the ball, nor does it provide any valuable information related to the state of the ball or RFID chip health.

Further, a RFID solution requires RFID sensors to read the RFID tag in the ball. This is not easily translatable to traditional golf courses as the infrastructure is not in place to read RFID signals.

Yet further, a RFID solution is relatively costly due to the sensor infrastructure needed, as well as the on-going maintenance of the said sensor.

BRIEF SUMMARY OF THE INVENTION

The primary purposes of the invention are to: Limit the need for costly infrastructure to identify a ball; create a self-powered product that can be used to relate various states of a golf ball; Actual speed, spin, compression, etc . . . ; Location relative to a golfer; Client application can ingest data, visualize for performance improvement opportunities, maintain historic stats related to shot data; allows a Topgolf Venue to limit costs related to the gaming system; Allows traditional golfers a way to find their ball on the course quicker; Speeds up rounds; and Limits number of lost balls per round.

One aspect of the present invention is a golf ball comprising a sphere, a core layer and a cover layer. The sphere comprises a body, a piezoelectric material and an electronic component. The electronic component comprises a plurality of stacked circuit boards and at least one battery disposed within the plurality of stacked circuit boards. The body is composed of an epoxy material. The body encompasses the electronic component. The core layer is disposed on the epoxy sphere. The cover layer is disposed over the core layer.

Another aspect of the present invention is a golf ball comprising a sphere, a core layer, a mantle layer and a cover. The sphere comprises a body, a piezoelectric material, and an electronic component. The electronic component comprises a plurality of stacked circuit boards and at least one battery disposed within the plurality of stacked circuit boards. The body is composed of an epoxy material and encompasses the electronic component. The core layer is disposed on the epoxy sphere, and comprises a polybutadiene and a graphene material in an amount ranging from 0.1 to 5.0 weight percent of the outer core. The outer core has a flexural modulus ranging from 80 MPa to 95 MPa.

This new design preferably uses a triangulation method to guide a player to a very close region around the golf ball.

By placing a magnetometer in the ball, the exact spin values are recorded (up to 5000 RPM).

The golf ball preferably creates a compact design due to the circuit board composed of a flexible material, such that the circuit board is wrapped around the batteries.

Another important aspect of the present invention is that the circuit board attaches directly to the battery using three contact points: one positive pad and two negative contacts, including the actual crystal cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 24:
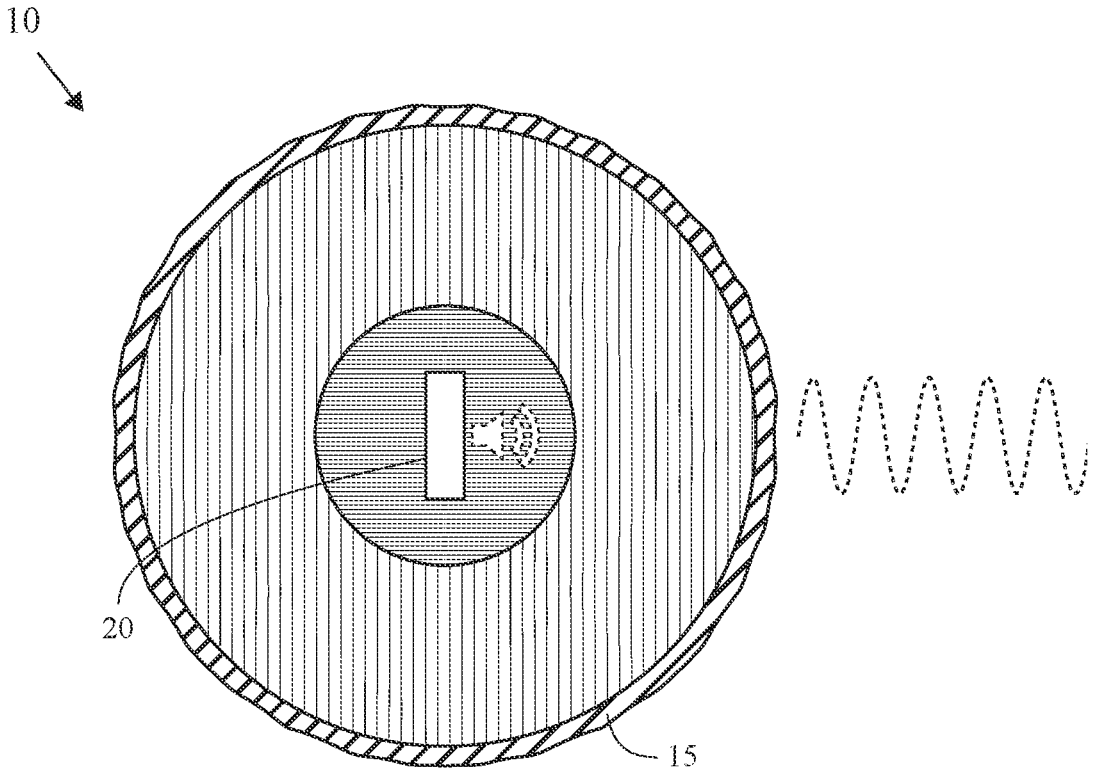
FIG. 24 is a cross-sectional view of a golf ball.
Figure 28A:
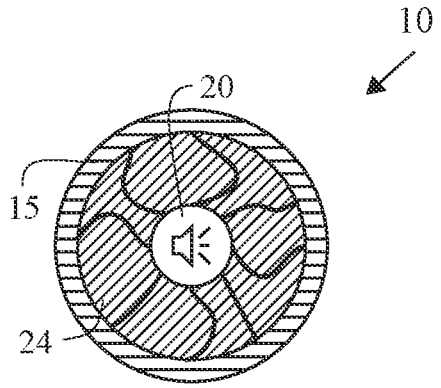
FIG. 28A is cross-sectional view of a golf ball with a piezoelectric material.

A golf ball 10 will be manufactured with piezoelectric materials 15, as shown in FIGS. 24 and 28A. Within the ball will be a computational device 20 that will be powered by a small battery also within the ball. Surrounding the computational device 20 is conductive polymer 24. The aforementioned piezoelectric materials will be integrated with the small battery so that when the materials experience mechanical stress, the resulting electrical current will be used to charge the small battery, and in turn, power the computational device. The computational device will contain gyros, accelerometers, etc., that will allow for the tracking of acceleration, motion, and elevation. It will also contain a low energy transmitter (e.g., Bluetooth, ultrasonic sound waves, etc.) that will be used to locate the ball after being hit. The transmitted data will be received by the golfer's mobile device and rendered/displayed through a mobile application developed specifically for this concept.

The present invention has the following features: Self-contained power supply that uses mechanical stress to recharge; Computational device that will record actual physical measurements related shot; Data transmission of ball state and location to a linked mobile device/receiver; and Ability to visualize ball state information for player improvement purposes.

Figure 28B:
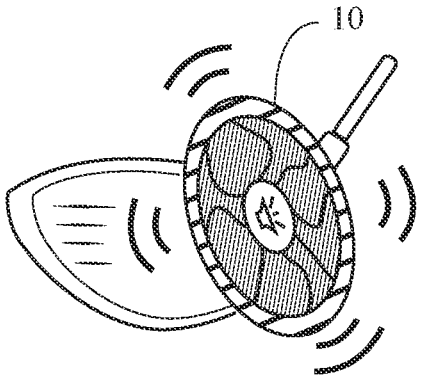
FIG. 28B is an illustration of the golf ball with a piezoelectric material being hit.

Piezoelectric materials have the ability to generate an alternating current (AC) voltage when subjected to mechanical stress or vibration and/or to vibrate when subjected to an AC voltage, shown in FIG. 28B as a golf ball being hit.

The two main advantages to the consumer will be a golf ball that records spin and a golf ball that can be easily found.

A magnetometer, preferably running at 85 Hz, inside a golf ball is able to measure spins of 5000 RPM. Measuring higher spin rates is also possible.

The entire circuitry is preferably inside a hard plastic molded sphere.

Data is transferred via BLE radio to a mobile device 120 (such as a phone).

Figure 1A:
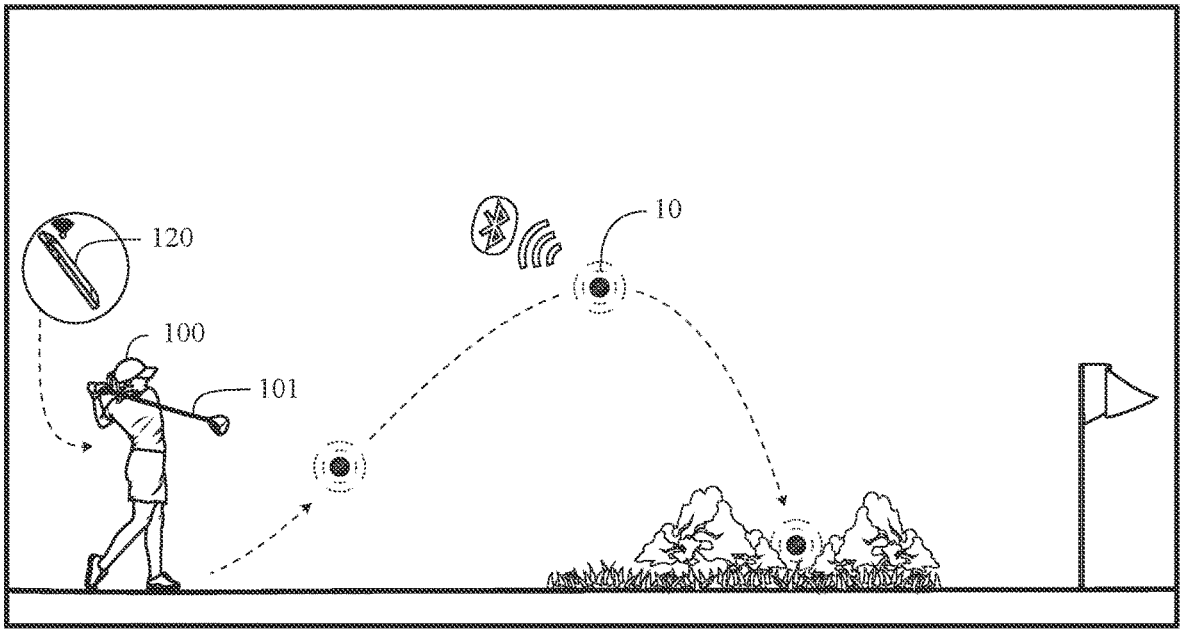
FIG. 1A is an illustration of an on-course use of the golf ball with a piezoelectric material.
Figure 1B:
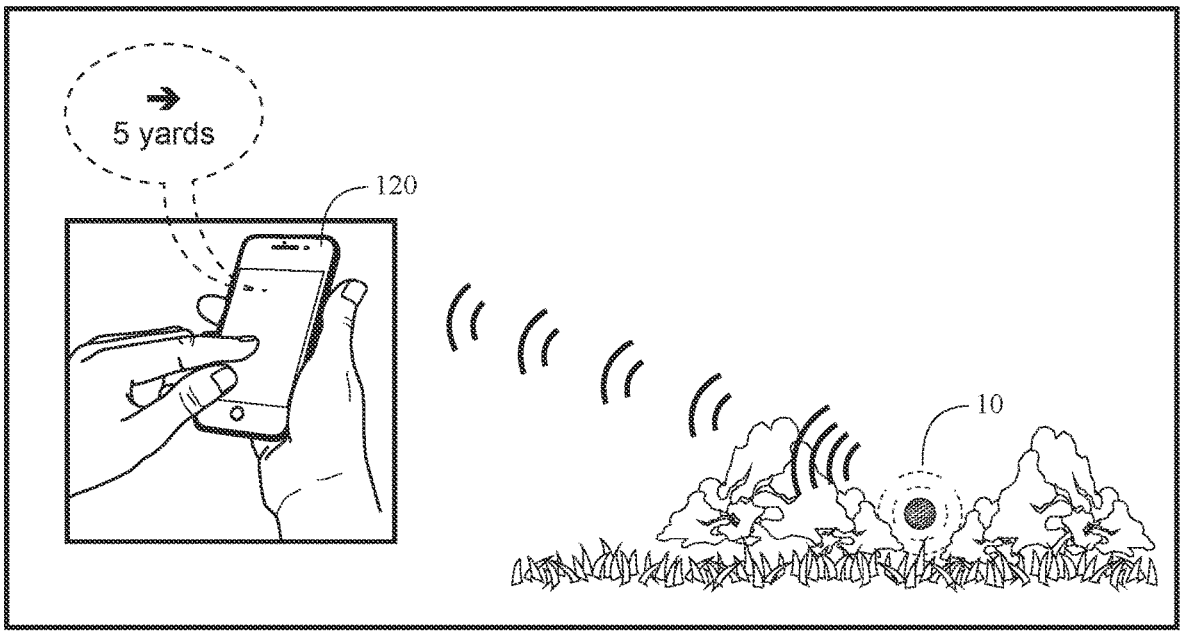
FIG. 1B is an illustration of an on-course use of the golf ball with a piezoelectric material

FIGS. 1A and 1B show a golfer 100 hitting a golf ball 10, with internal circuitry according to the present invention therein, with a golf club 101 which then lands in landscape that makes it difficult to see the golf ball 10. A mobile device 120, such as a mobile phone, receives a BLUETOOTH low energy wireless communication transmission from the golf ball 10. Using an application on the mobile device 120, the golfer can easily find the golf ball.

The circuitry 20 inside the ball 10 preferably activates at impact using a shock switch for power savings, as shown in FIGS. 28B and 1A. At rest, after the shot, the ball keeps sending the data and going back to sleep mode every second until the user finds it using the mobile device 120 and acknowledges it in the application, as shown in FIG. 1B.

A golf ball 10 is found using triangulation of the RSSI from the golf ball 10 to the mobile device 120. The user will be instructed to move forward and to the side to generate enough space for the triangulation.

Figure 25:
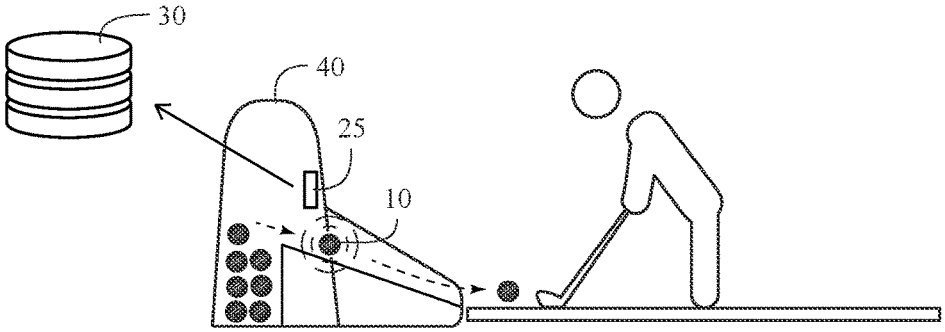
FIG. 25 is an illustration of a golfer at a golf dispenser at an entertainment venue.
Figure 26:
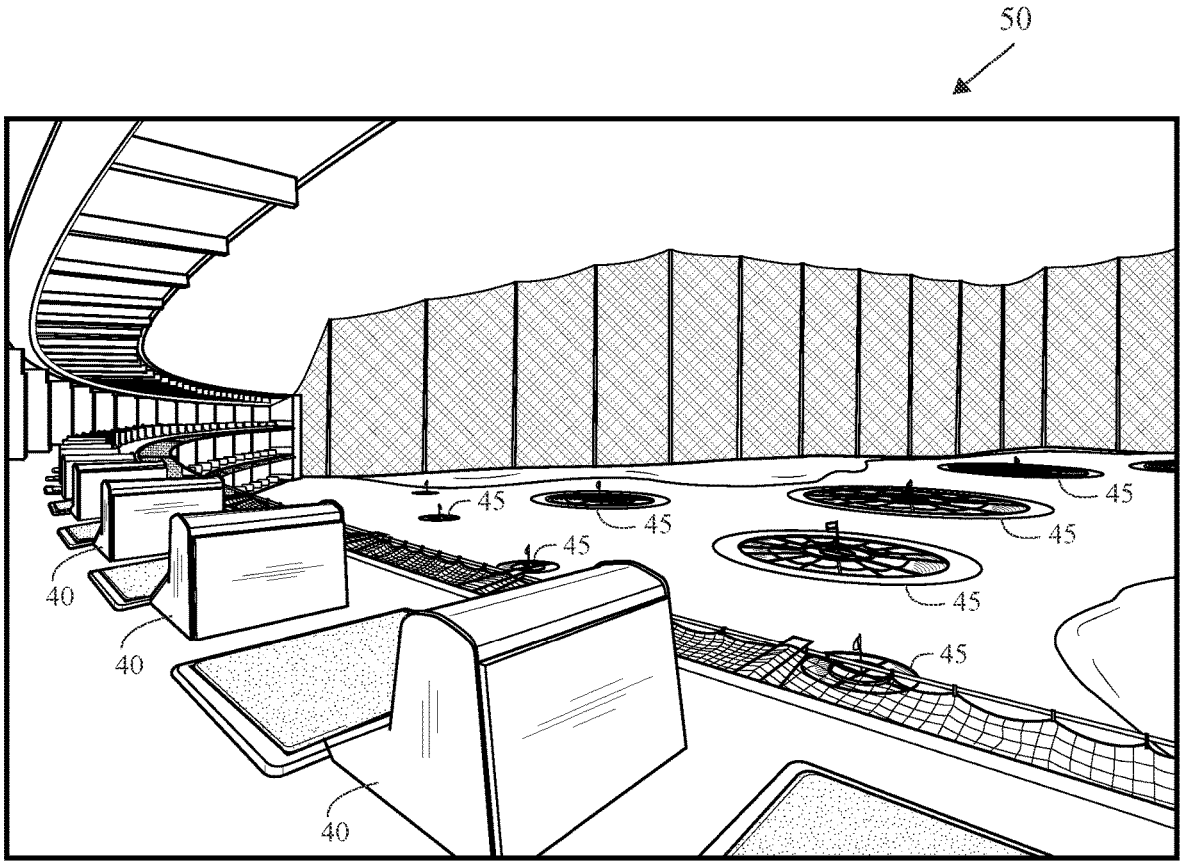
FIG. 26 is an illustration of an entertainment venue.
Figure 27:
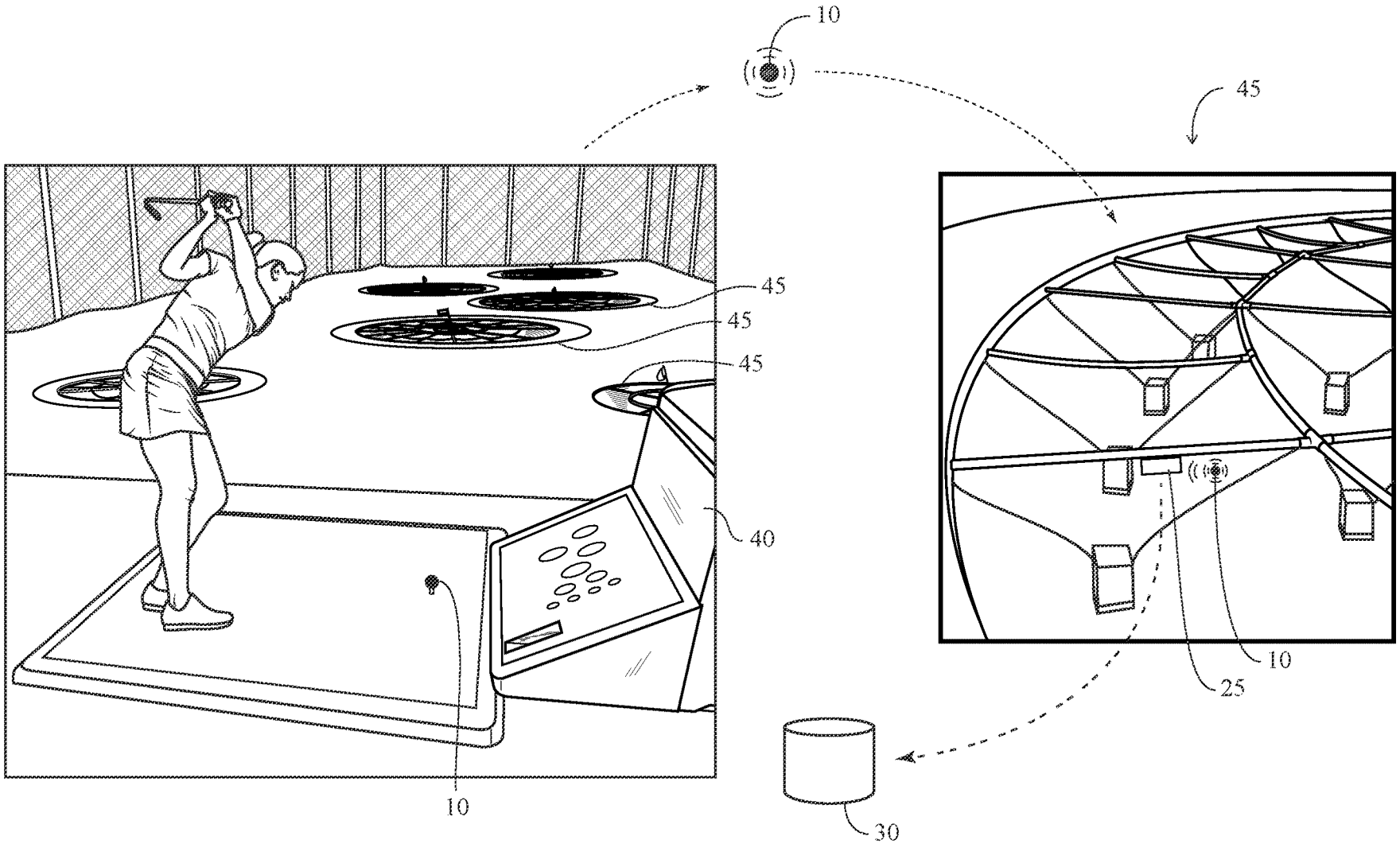
FIG. 27 is an illustration of an entertainment venue use of the golf ball with a piezoelectric material.

FIGS. 25-27 show the same implementation of using the golf ball 10 of FIGS. 24 and 28A at an entertainment venue. The golf facility 50 comprises of ball dispensers 40 and targets 45. The ball dispenser 40 comprises an ultrasonic data receiver 25 which sends data to a database 30 when a ball 10 is dispensed, shown in FIG. 25. A golfer hits a dispensed ball 10 towards a target 45. When the ball 10 lands in a target 45, it passes a data receiver 25 which sends back data to a database 30, thereby keeping track of the golfer's ball, and also any statistics. The data can be displayed either on a screen on the dispenser or on a screen nearby, or on a mobile device 120.

Internal circuitry is embedded within the golf ball. The internal circuitry comprises at least a BLUETOOTH Low Energy radio (5th generation), a processor, a magnetometer, an accelerometer, and a battery. The internal circuit may also have a memory. A KIONIX chip is preferred. The 5th generation BLUETOOTH Low Energy radio has a range of at least 700 meters. Triangulation is used to find a golf ball on course. The battery is preferably a 2032 coin cell. A NF52 Nordic processor is preferably utilized. A KIONIX 3-axis accelerometer is preferably utilized.

Figure 2:
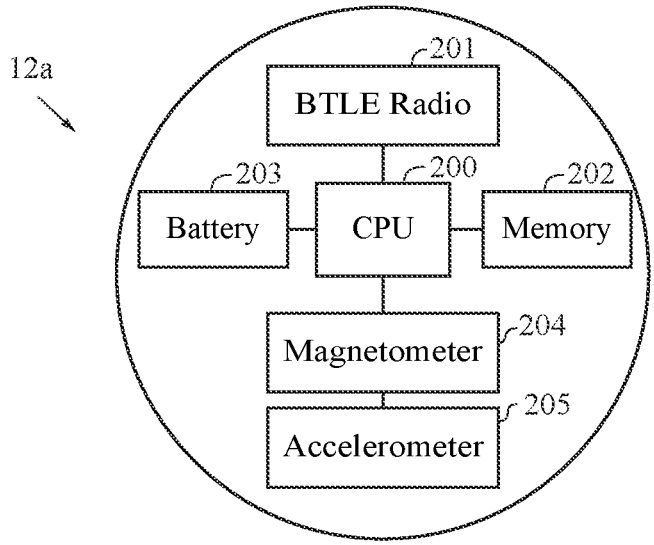
FIG. 2 is a block diagram of the internal circuitry.

FIG. 2 is a block diagram of the internal circuitry within the inner core 12*a* of the golf ball 10. The internal circuitry preferably includes a CPU 200, a BTLE radio 201, a memory 202, a battery 203, a magnetometer 204 and an accelerometer 205.

Figure 3:
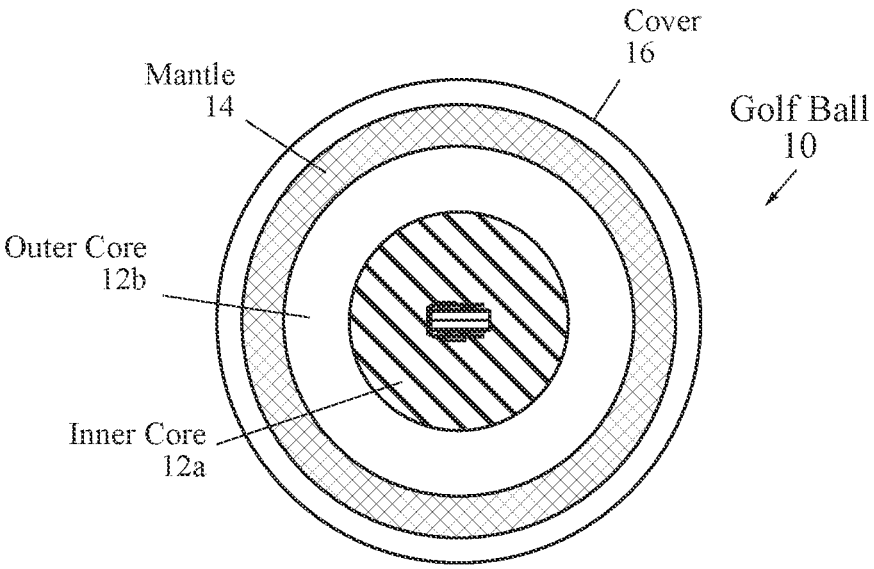
FIG. 3 is a cross-sectional view of a golf ball with an internal circuitry therein.

FIG. 3 is a cross-sectional view of a golf ball with an internal circuitry therein. The inner core 12*a* is preferably composed of an epoxy material.

Figure 4:
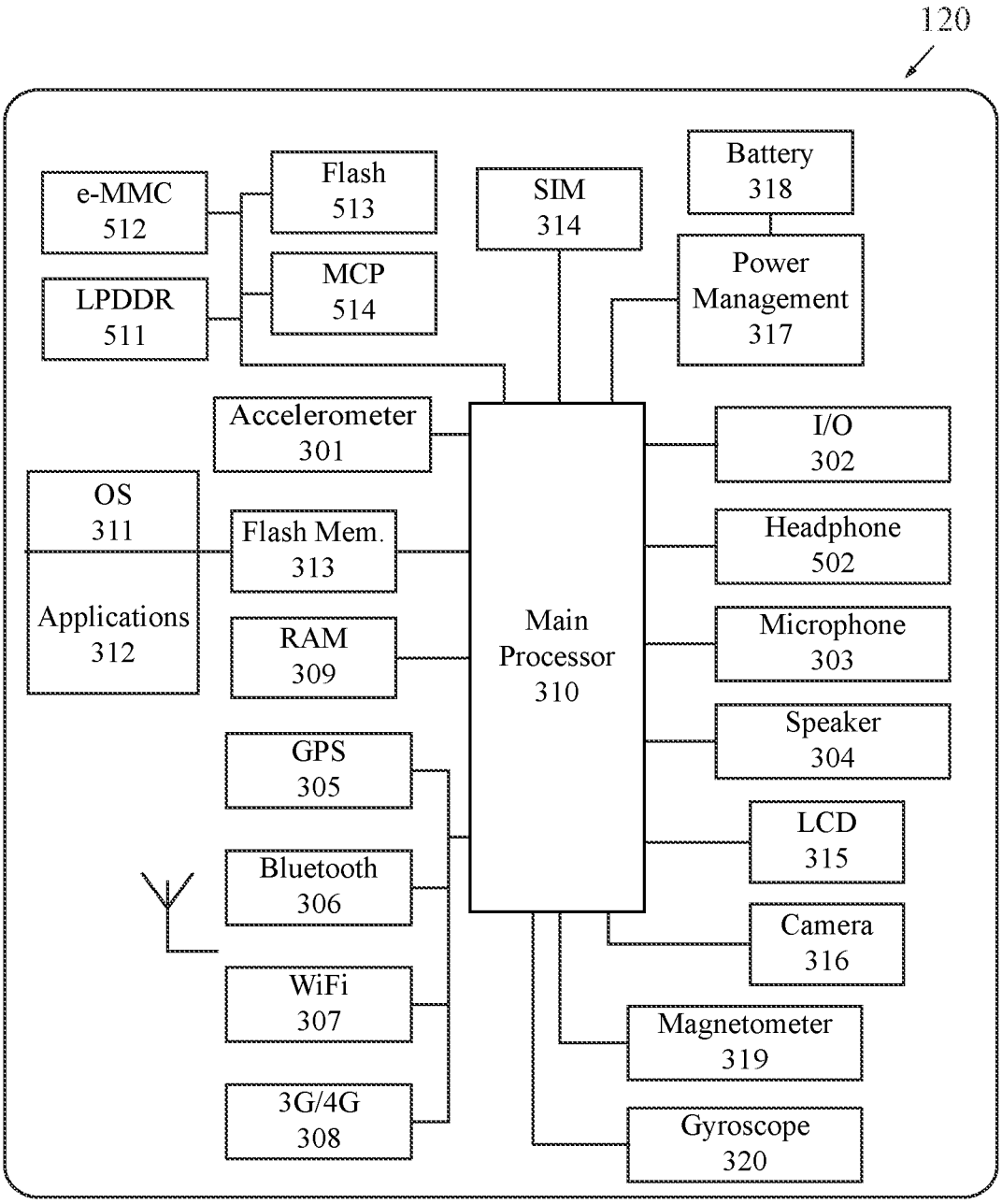
FIG. 4 is a block diagram of components of a mobile device.

FIG. 4 is a block diagram of components of a mobile device 120. The mobile device 120 preferably comprises an accelerometer 301, an input/output module 302, a microphone 303, a speaker 304, a GPS 305, a BLUETOOTH transceiver 306, a WiFi transceiver 307, a 3G/4G transceiver 308, a RAM memory 309, a main processor 310, an operating system (OS) module 311, an applications module 312, a flash memory 313, a SIM card 314, a LCD display 315, a camera 316, a power management module 317, a battery 318, a magnetometer 319, a gyroscope 320*a* LPDDR module 511, a e-MMC module 512, a flash module 513, and a MCP module 514.

Figure 5:
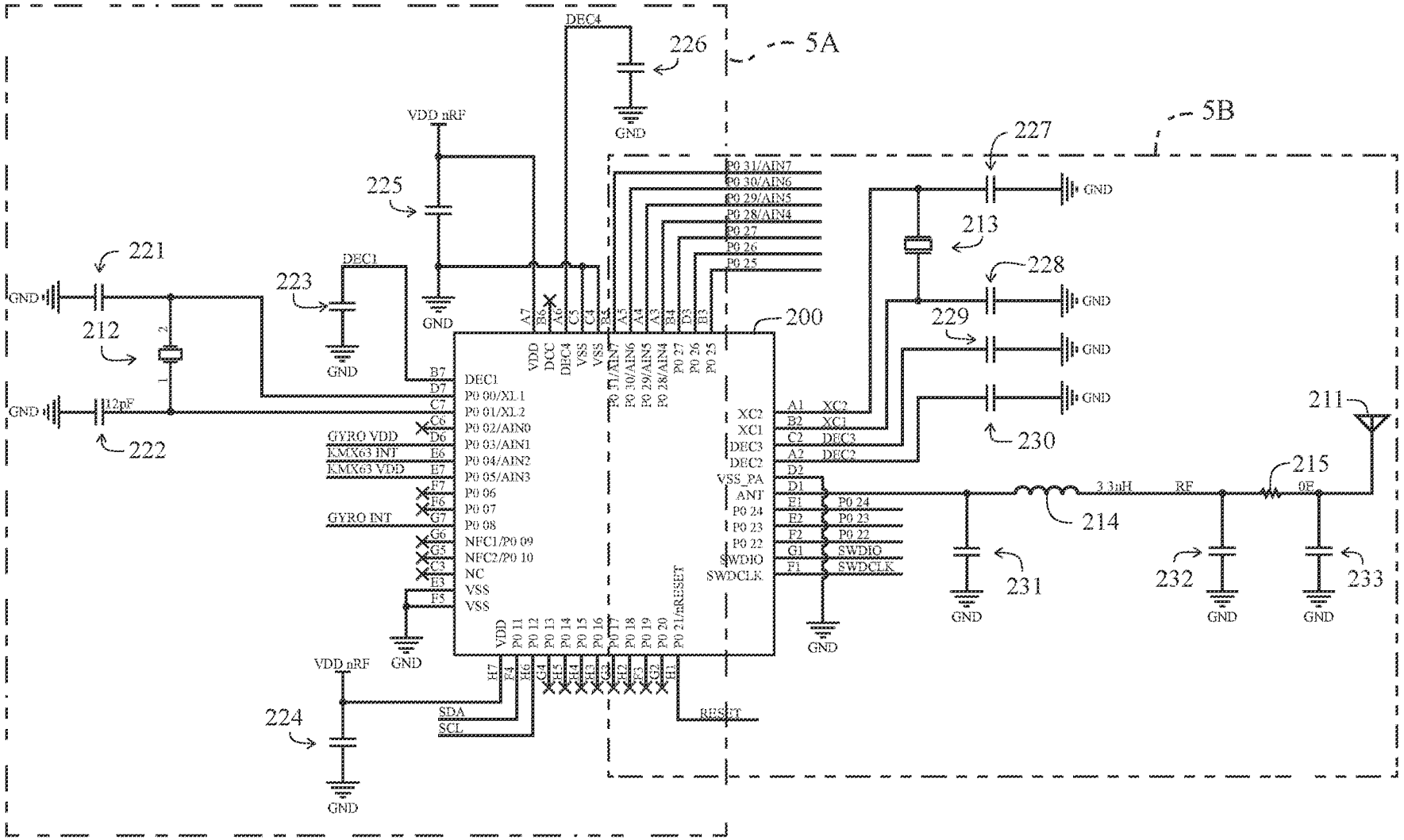
FIG. 5 is a circuit diagram.
Figure 5A:
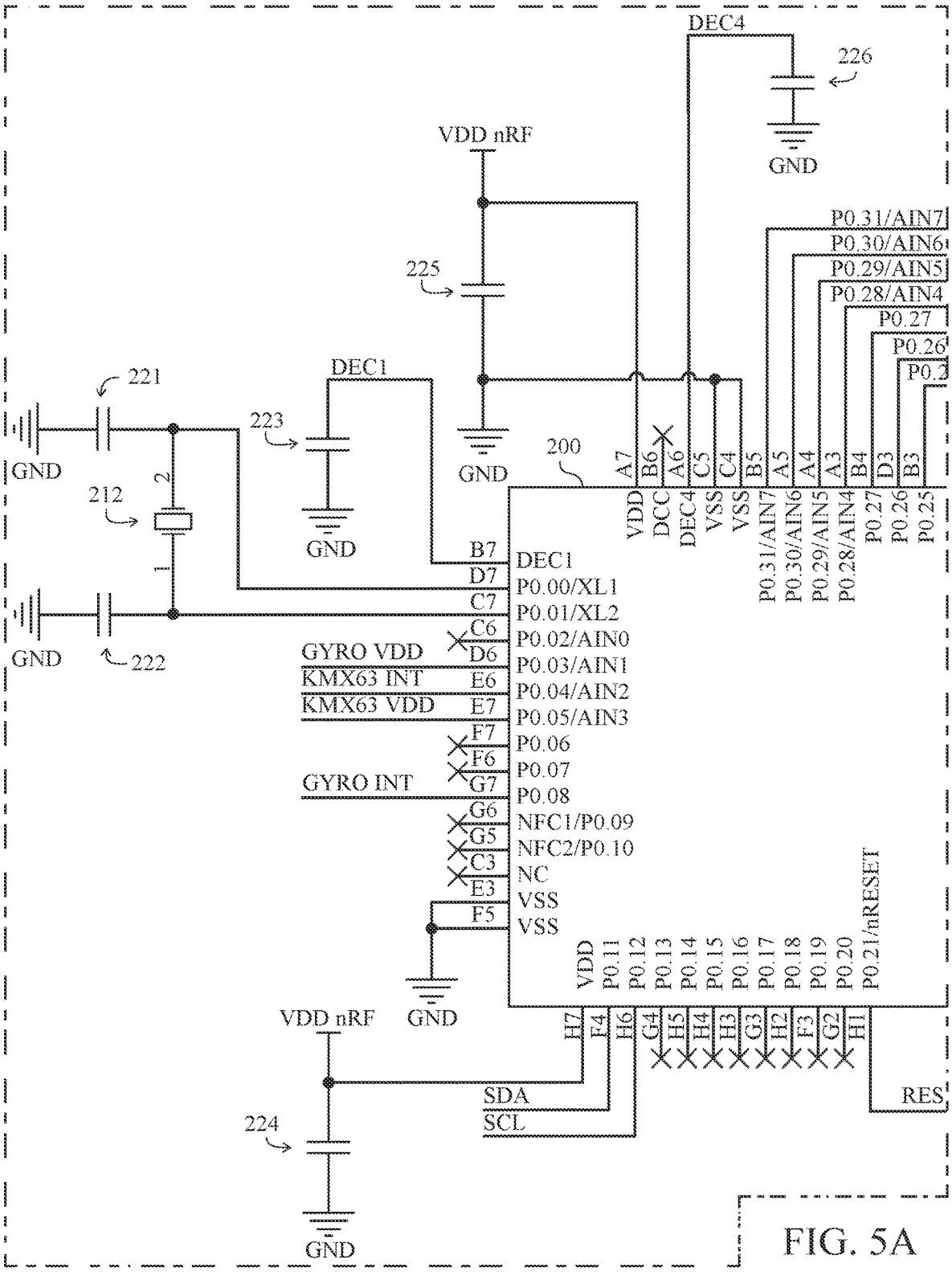
FIG. 5A is a circuit diagram.
Figure 5B:
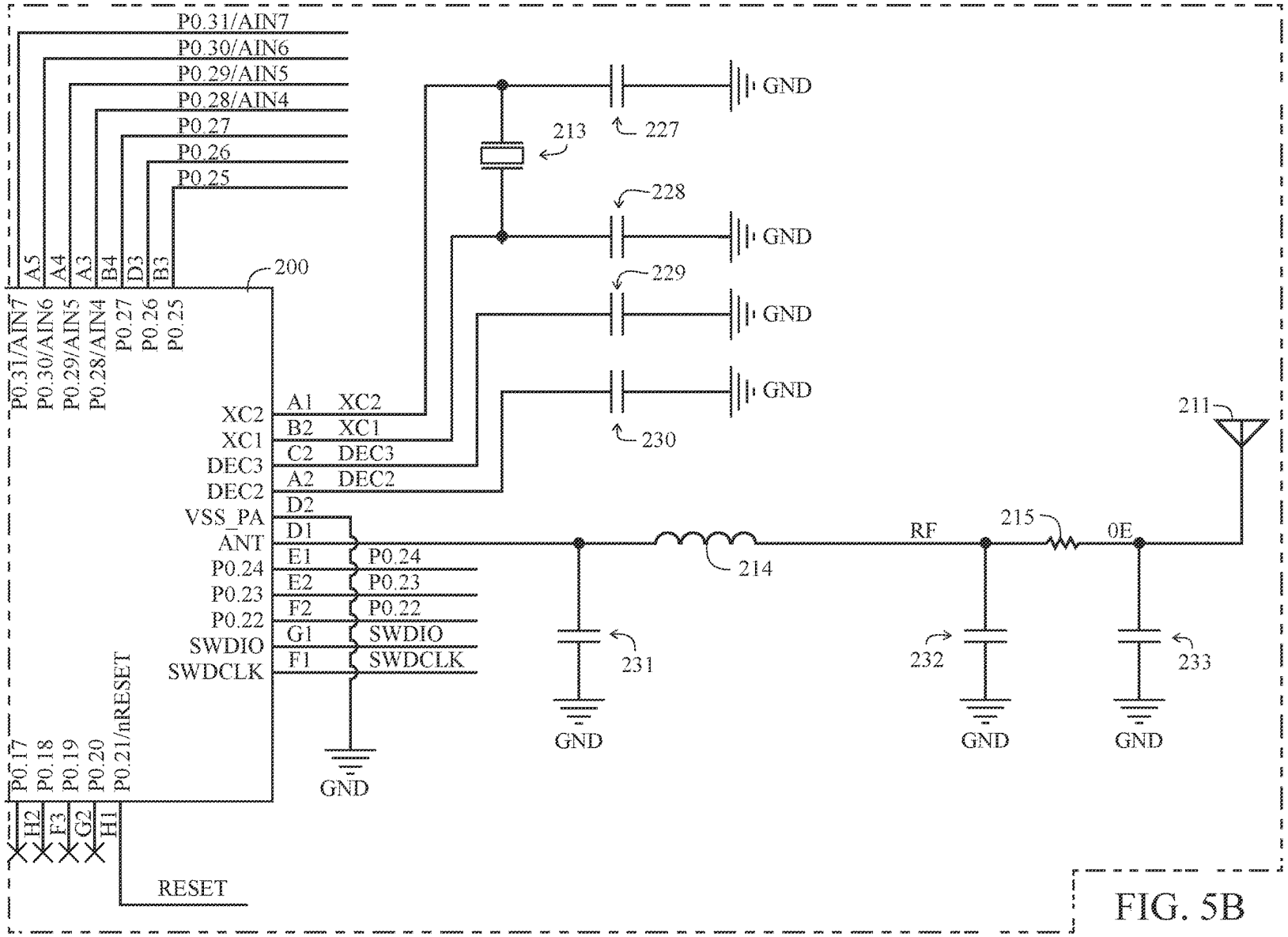
FIG. 5B is a circuit diagram.

FIGS. 5, 5A and 5B illustrate circuit diagrams of the internal circuitry of the golf ball 10. The internal circuitry preferably includes a CPU 200, an antenna 211, a first crystal oscillator 212, a second crystal oscillator (XTAL SMD 2016, 32 MHz) 213, an inductor (3.3 nH) 214, a resistor 215, a first capacitor (12 picoFaradays "pF") 221, a second capacitor (12 pF) 222, a third capacitor (100 nano Faradays "nF") 223, a fourth capacitor (100 nF) 224, a fifth capacitor (4.7 microFaradays "uF") 225, a sixth capacitor (100 nF) 226, a seventh capacitor (12 pF) 227, an eighth capacitor (12 pF) 228, a ninth capacitor (100 pF) 229, a tenth capacitor (100 pF) 230, an eleventh capacitor (100 nF) 231, a twelfth capacitor (NS) 232, and a thirteenth capacitor (NS) 233.

Figure 5C:
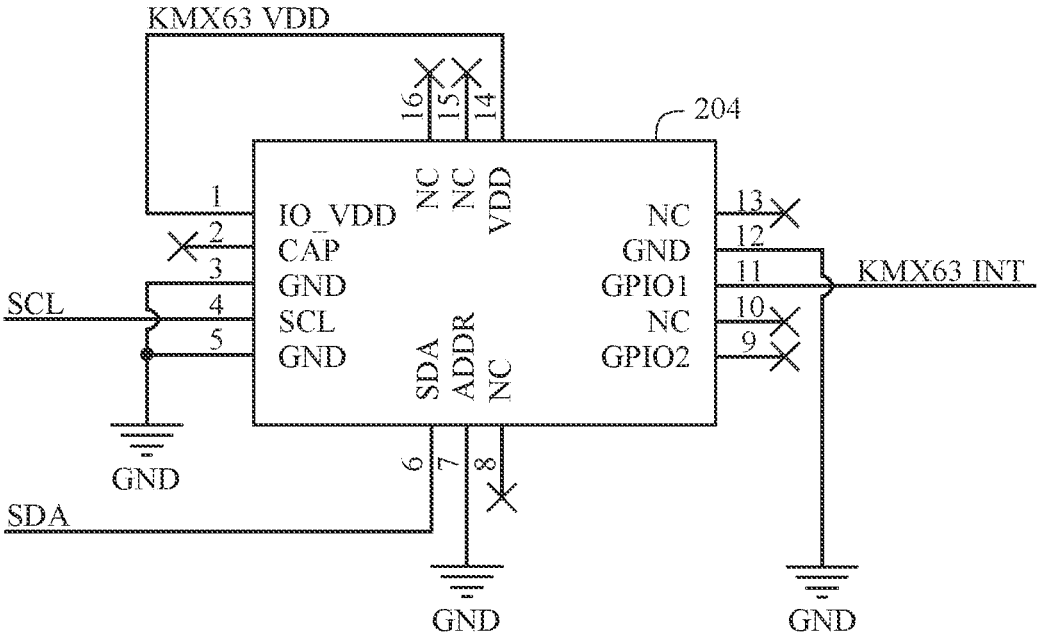
FIG. 5C is a circuit diagram.

FIG. 5C is a circuit diagram of magnetometer/accelerometer 204, preferably a medium-G, wide bandwidth tri-axis magnetometer/tri-axis accelerometer.

Figure 5D:
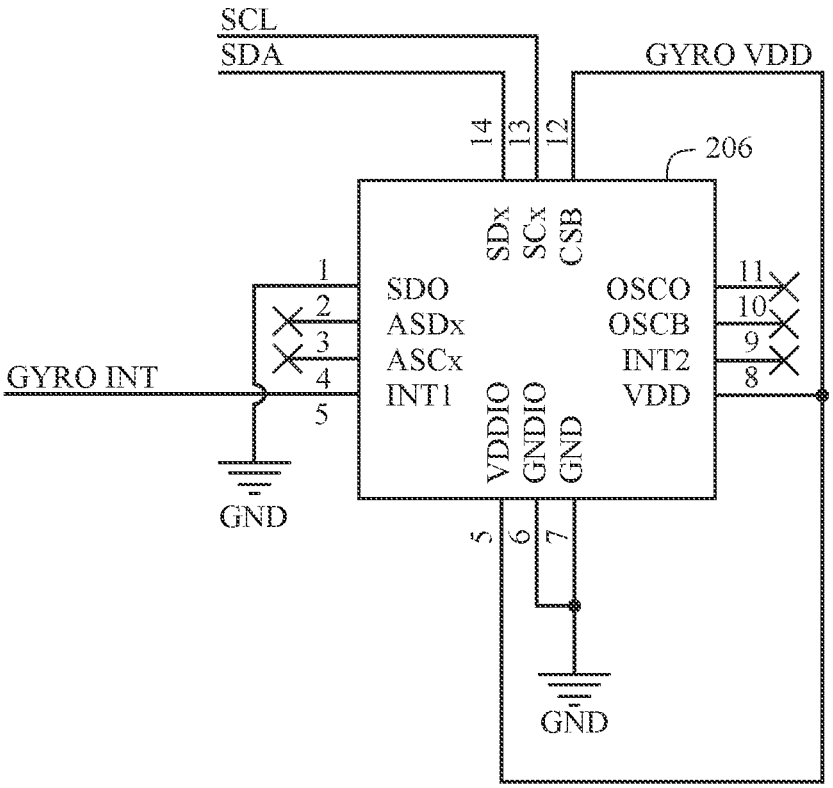
FIG. 5D is a circuit diagram.

FIG. 5D is a circuit diagram for a gyroscope 206, preferably a BOSCH SENSORTEC BMG250 gyroscope.

Figure 5E:
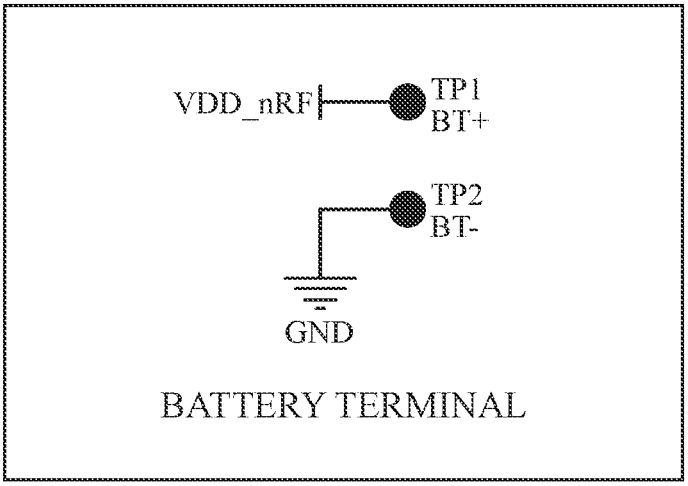
FIG. 5E is a circuit diagram.

FIG. 5E is a circuit diagram of a battery terminal.

Figure 5F:
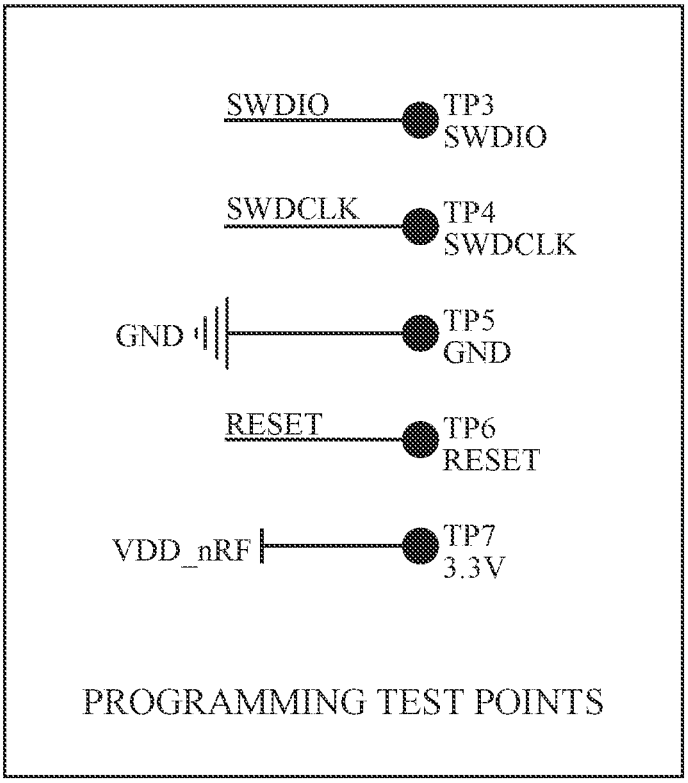
FIG. 5F is a circuit diagram.

FIG. 5F is a circuit diagram of programming test points.

Figure 6:
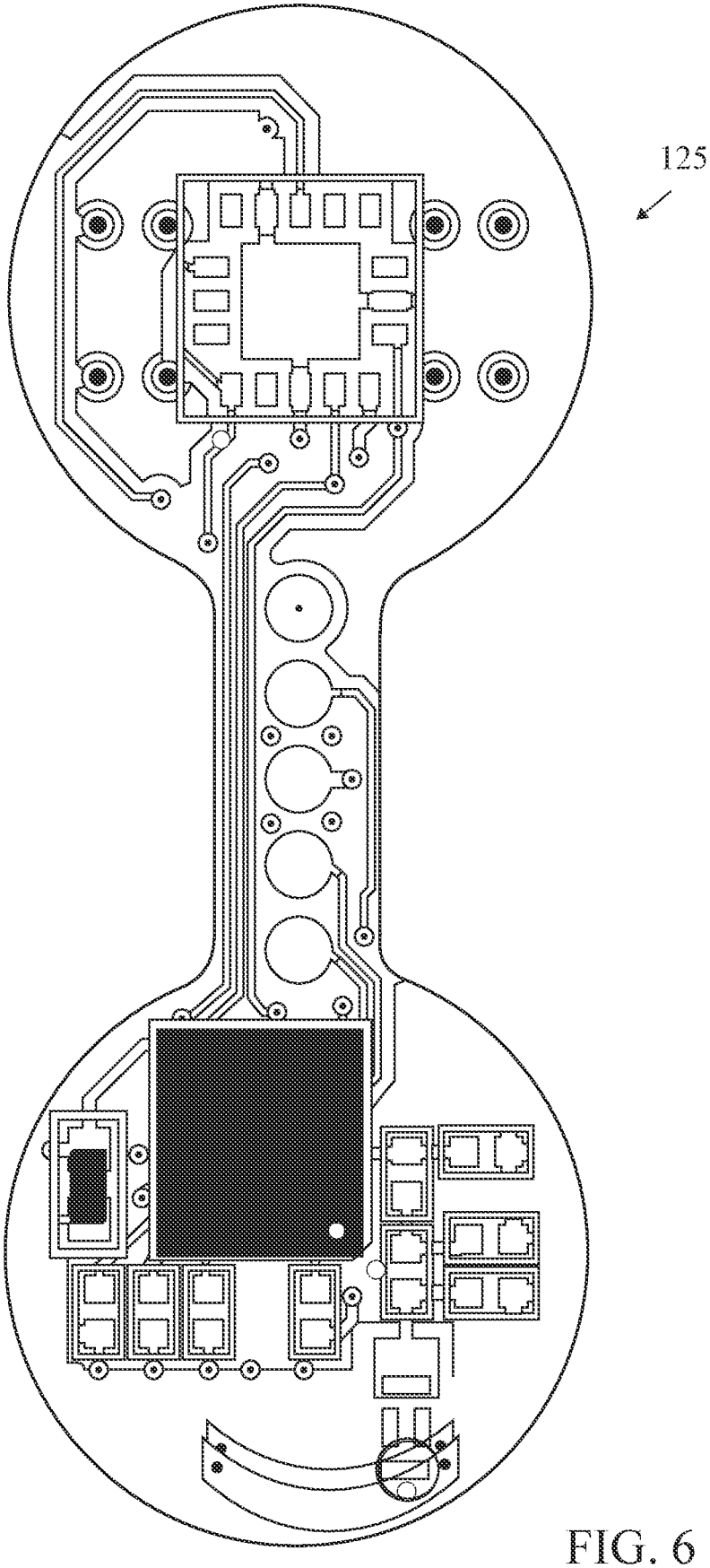
FIG. 6 is a top plan view of a flexible circuit board.

FIG. 6 is a top plan view of a flexible circuit board 125.

Figure 7:
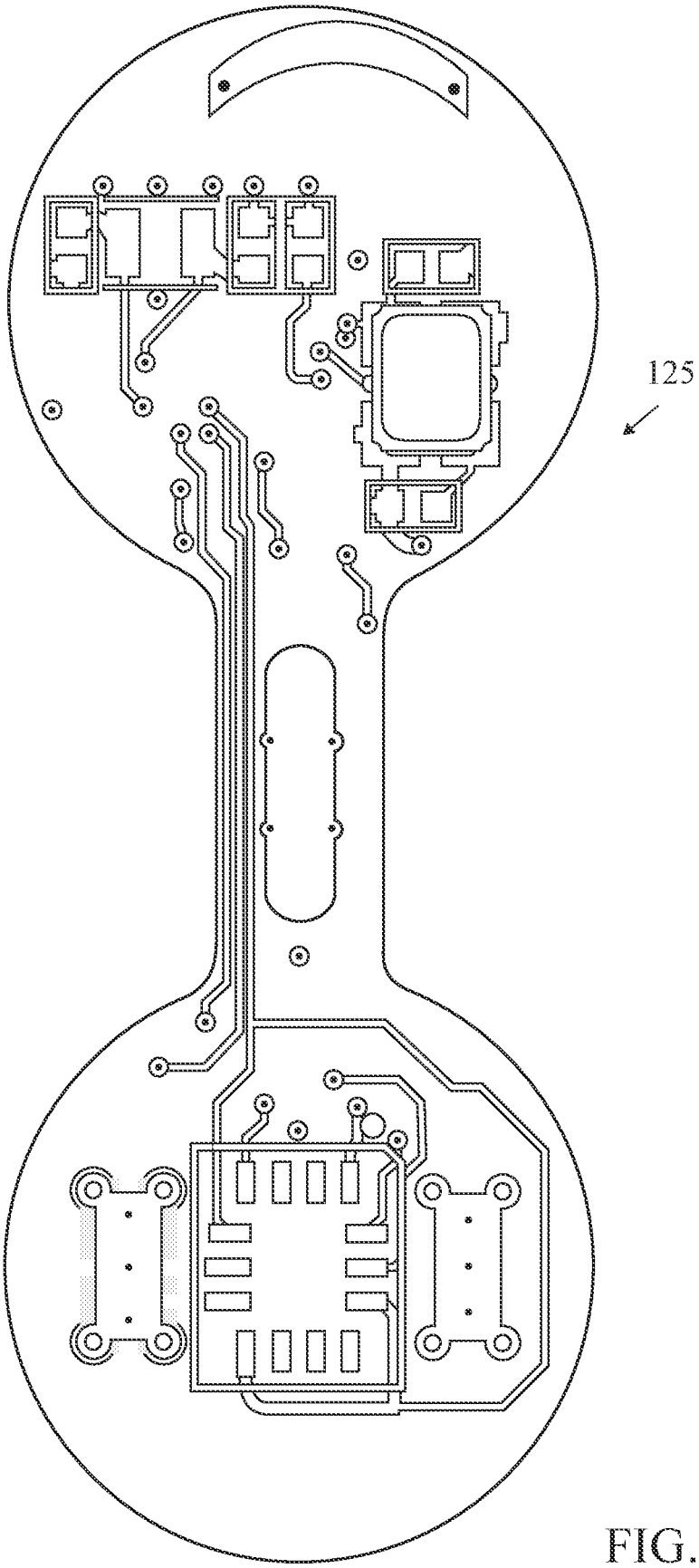
FIG. 7 is a bottom plan view of a flexible circuit board.

FIG. 7 is a bottom plan view of a flexible circuit board 125.

Figure 8:
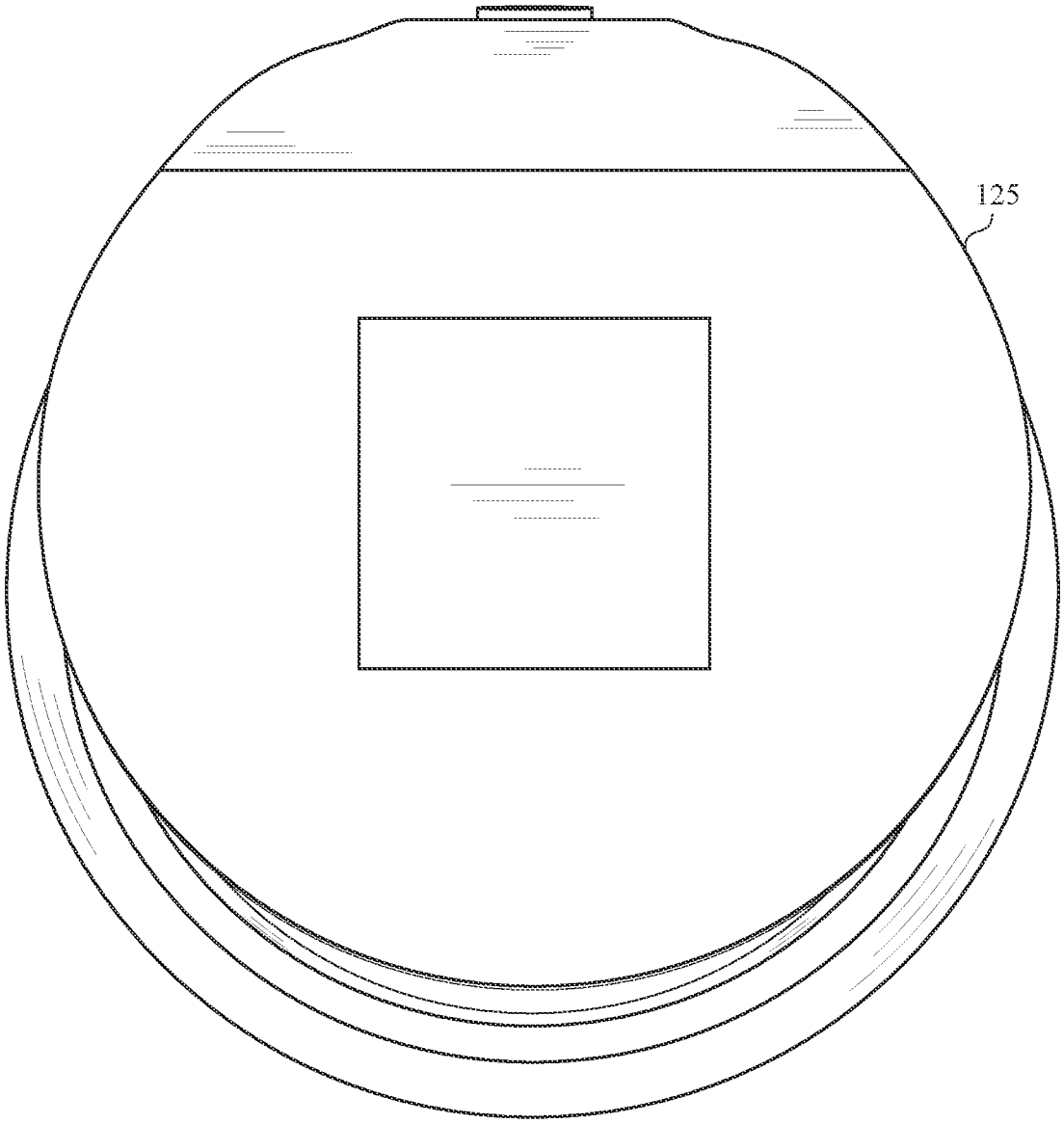
FIG. 8 is an illustration of an electronic component.

FIG. 8 is an illustration of a folded flexible circuit board 125.

Figure 9:
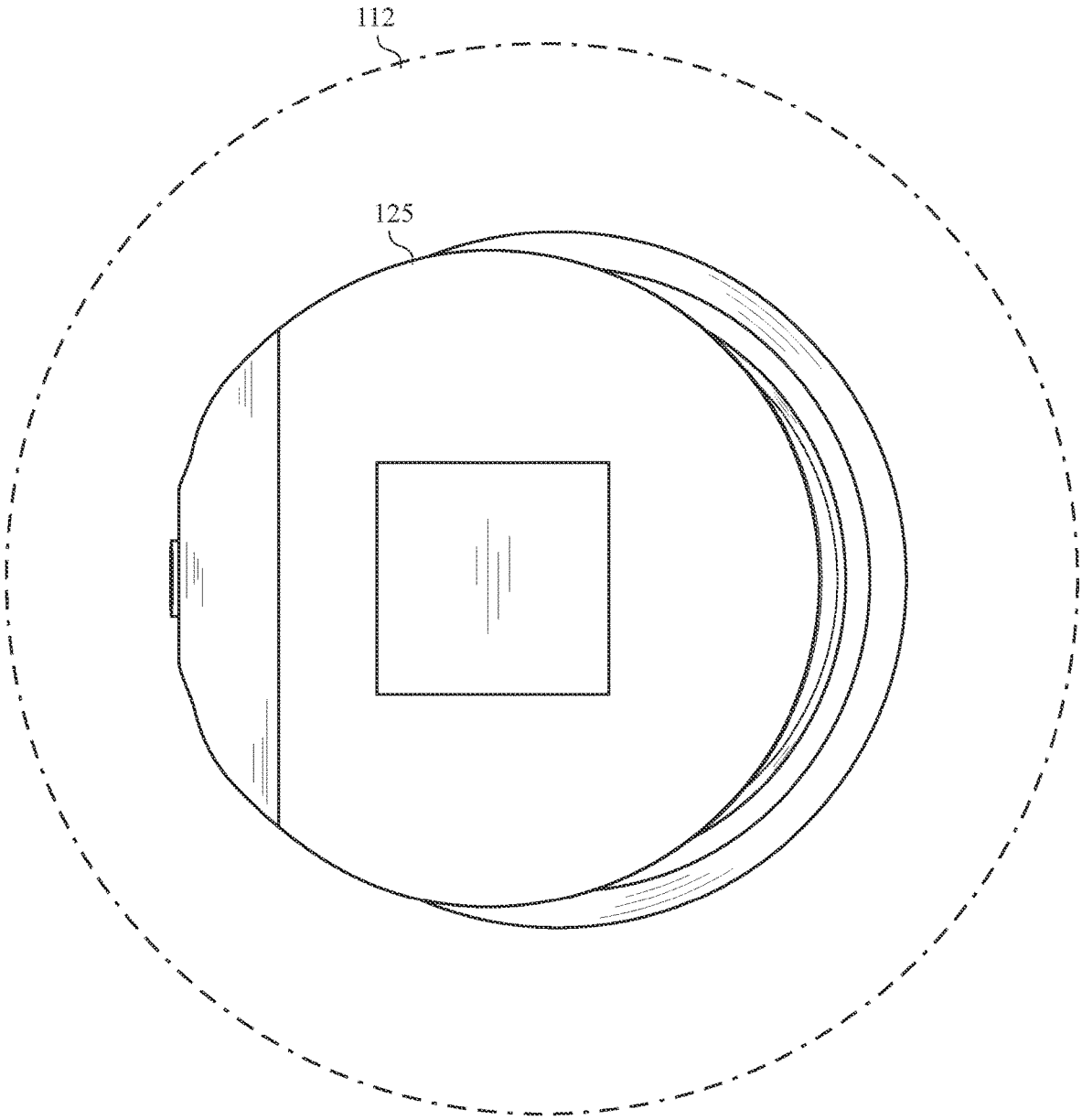
FIG. 9 is an illustration of an electronic component within an epoxy sphere for a golf ball.

FIG. 9 is an illustration of a folded flexible circuit board 125 within an epoxy sphere core 112 of a golf ball.

Figure 10A:
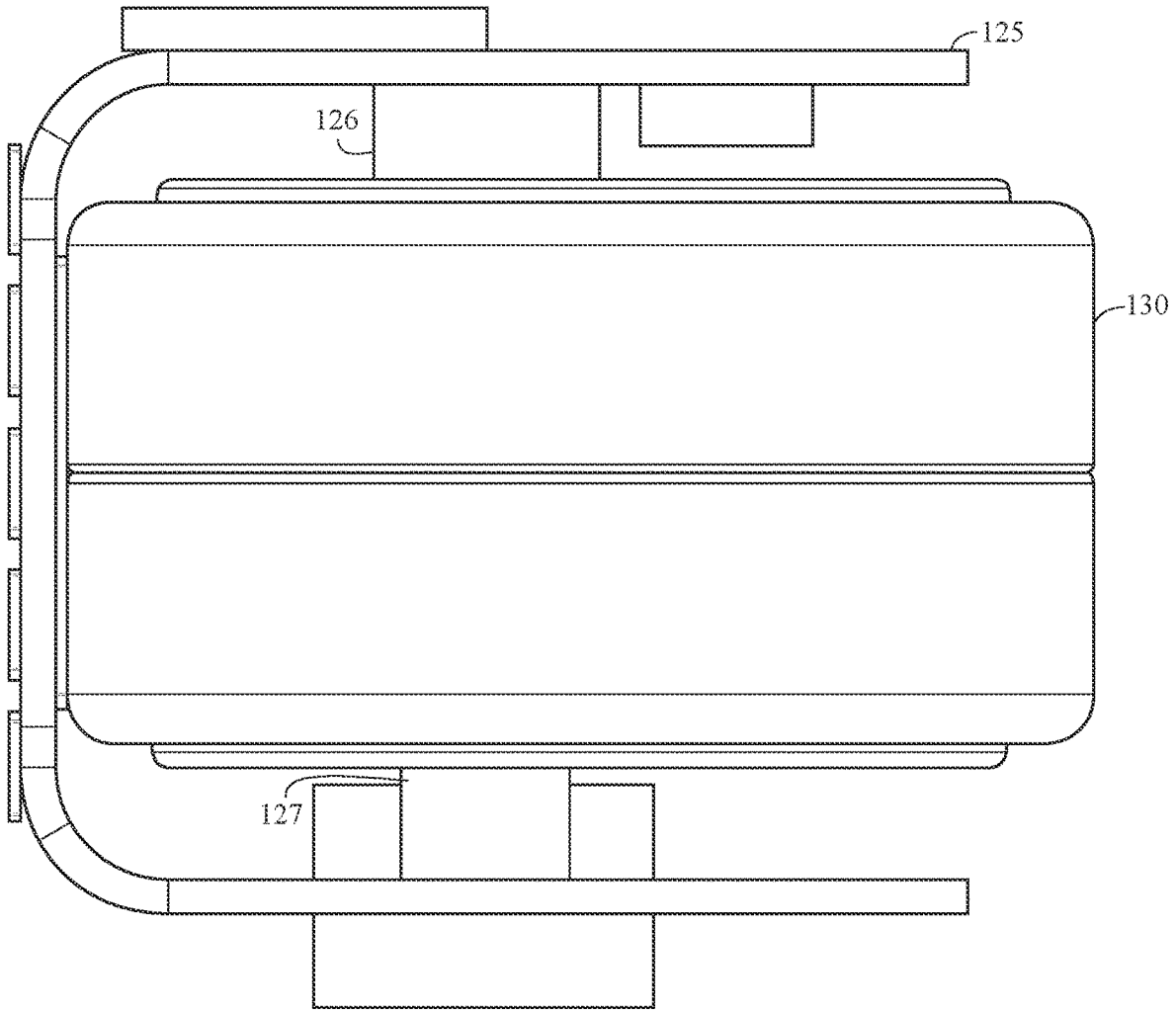
FIG. 10A is an illustration of a flexible circuit board wrapped around multiple batteries.

FIG. 10A is an illustration of a flexible circuit board 125 wrapped around multiple batteries 130 and connected to the batteries 130 by contacts 126 and 127.

Figure 10B:
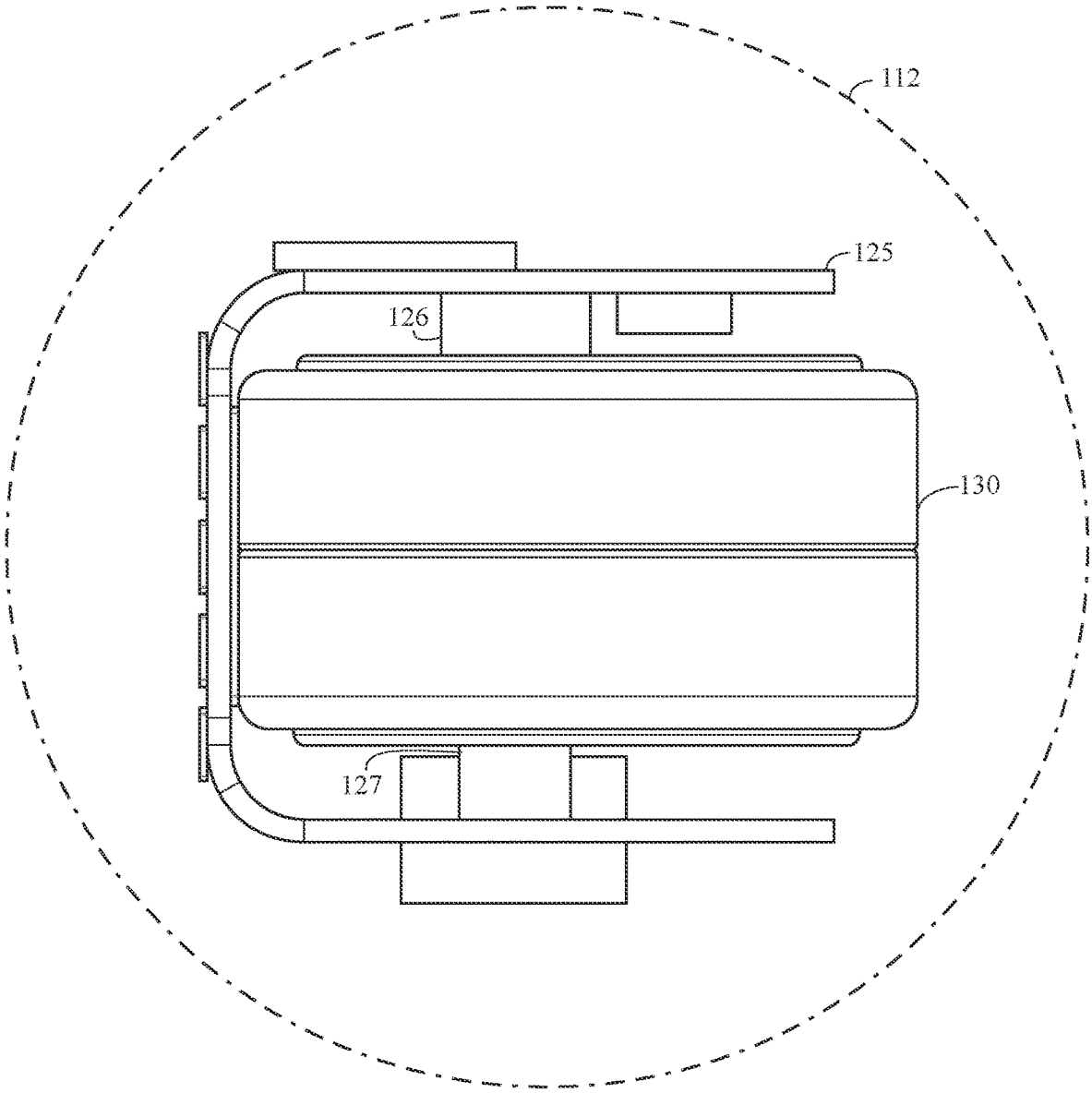
FIG. 10B is an illustration of a flexible circuit board wrapped around multiple batteries within an epoxy sphere for a golf ball.

FIG. 10B is an illustration of a flexible circuit board 125 wrapped around multiple batteries 130 and connected to the batteries 130 by contacts 126 and 127, and within an epoxy sphere core 112 for a golf ball.

One embodiment is a golf ball 10 comprising an epoxy sphere 112, a core layer and a cover layer. The epoxy sphere 112 comprises a body and at least one electrical component 125. The electrical component preferably comprises a plurality of stacked circuit boards and at least one battery 130 disposed within the plurality of stacked circuit boards. The body is preferably composed of an epoxy material. The body encompasses the electrical component. The core layer is disposed on the epoxy sphere. The cover layer is disposed over the core layer.

The core layer preferably comprises polybutadiene material and a graphene material in an amount ranging from 0.1 to 5.0 weight percent of the outer core, wherein the outer core has a flexural modulus ranging from 80 MPa to 95 MPa.

The plurality of stacked circuit boards preferably comprises an integrated circuit, a gyroscope, a magnetometer, and an antenna.

The electrical component preferably has a width ranging from 5 to 20 mm, a height ranging from 5-20 mm and a length ranging from 5-20 mm.

The epoxy sphere preferably has a diameter ranging from 0.4 inch to 0.9 inch, and more preferably a diameter ranging from 0.45 inch to 0.6 inch.

The integrated circuit is preferably flexible and is wrapped around the at least one battery.

The integrated circuit is attached to the at least on battery at three contact points.

The electrical component is preferably centered within the epoxy sphere.

The integrated circuit comprises a BLUETOOTH antenna, a 1 GigaHertz antenna, a microcontroller and a radiofrequency transceiver.

The integrated circuit preferably comprises a plurality of capacitors and at least one inductor.

The electrical component preferably detects a spin of the golf ball and transmits a signal to a mobile device.

Figure 11:
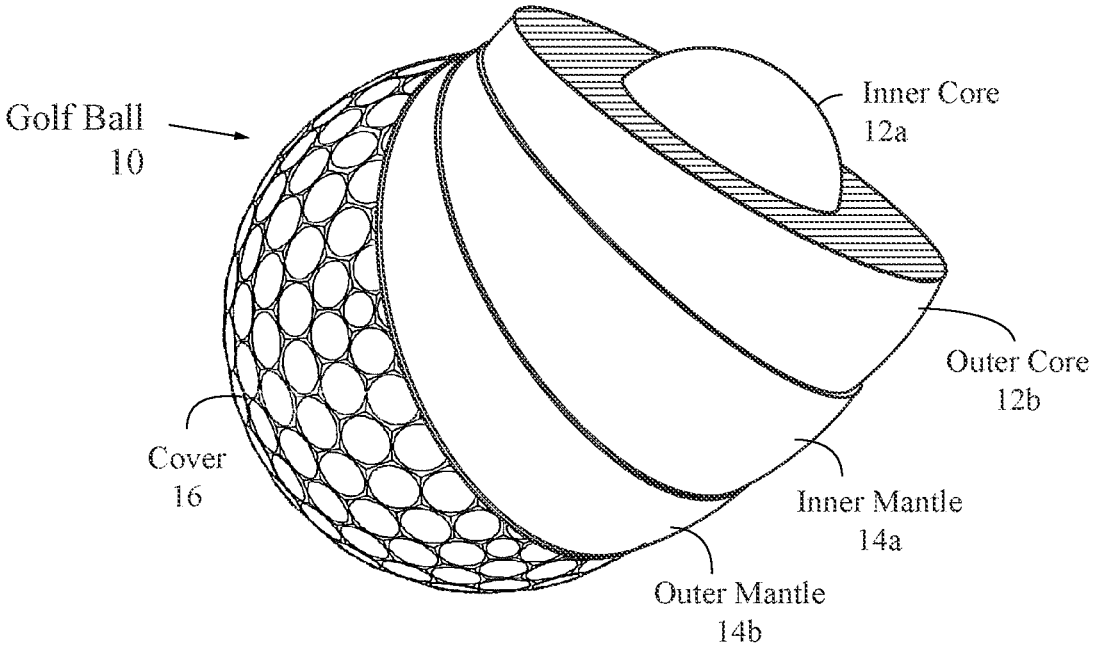
FIG. 11 is an exploded partial cut-away view of a golf ball.
Figure 12:
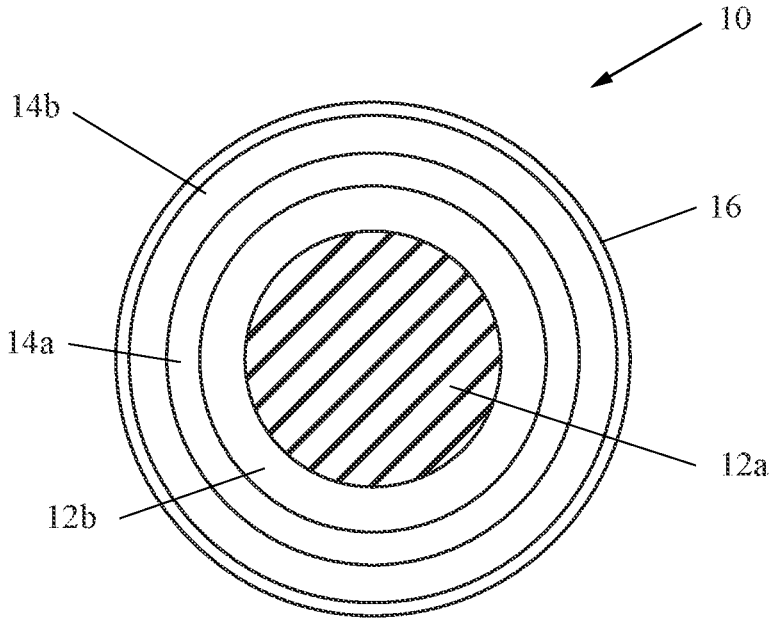
FIG. 12 is a cross-sectional view of an inner core layer, an outer core layer, an inner mantle layer, an outer mantle layer and a cover layer of a golf ball.

FIGS. 11 and 12 illustrate a five piece golf ball 10 comprising an inner core 12*a*, an outer core 12*b*, an inner mantle 14*a*, an outer mantle 14*b*, and a cover 16, with an internal circuitry comprising at least a BLUETOOTH Low Energy radio (5th generation), a processor, a magnetometer, an accelerometer, and a battery. The internal circuit may also have a memory.

Figure 13:
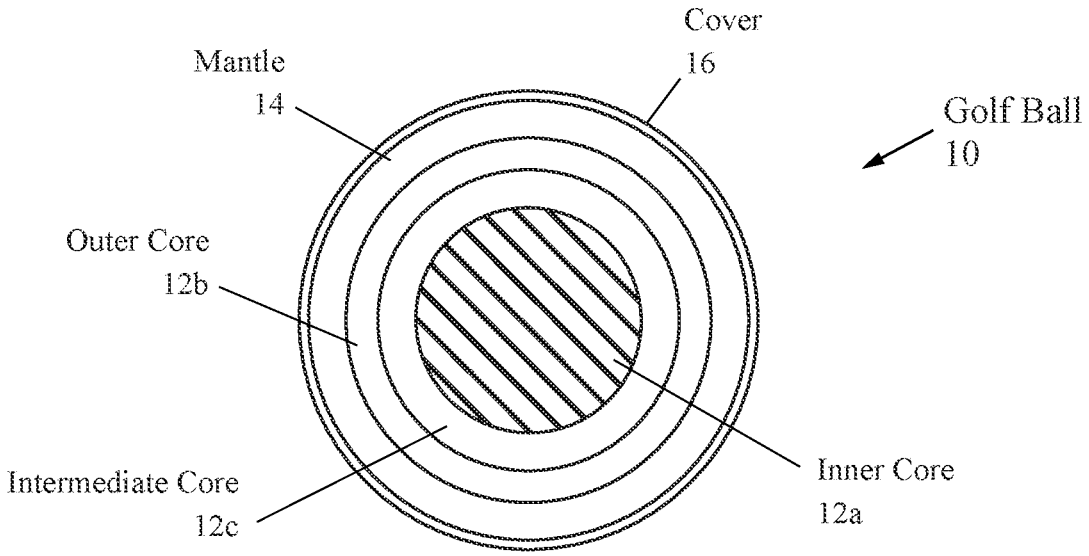
FIG. 13 is a cross-sectional view of an inner core layer, an intermediate core layer, an outer core layer, a mantle layer and a cover layer of a golf ball.

FIG. 13 illustrates a five piece golf ball 10 comprising an inner core 12*a*, an intermediate core 12*c*, an outer core 12*b*, a mantle 14, and a cover 16.

Figure 16A:
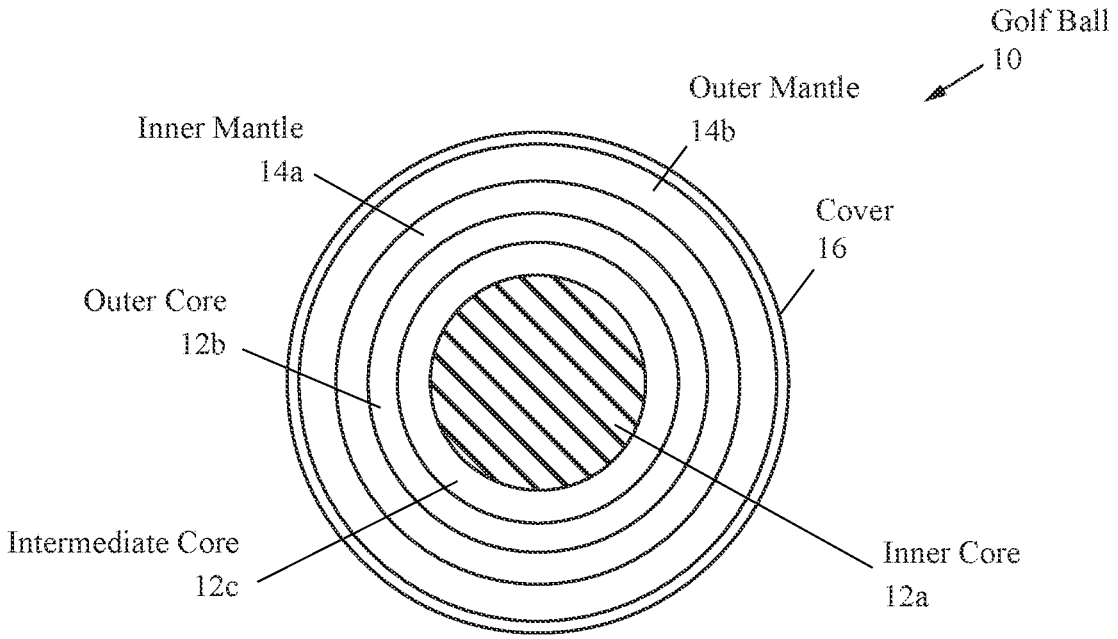
FIG. 16A is a cross-sectional view of a six-piece golf ball.
Figure 16B:
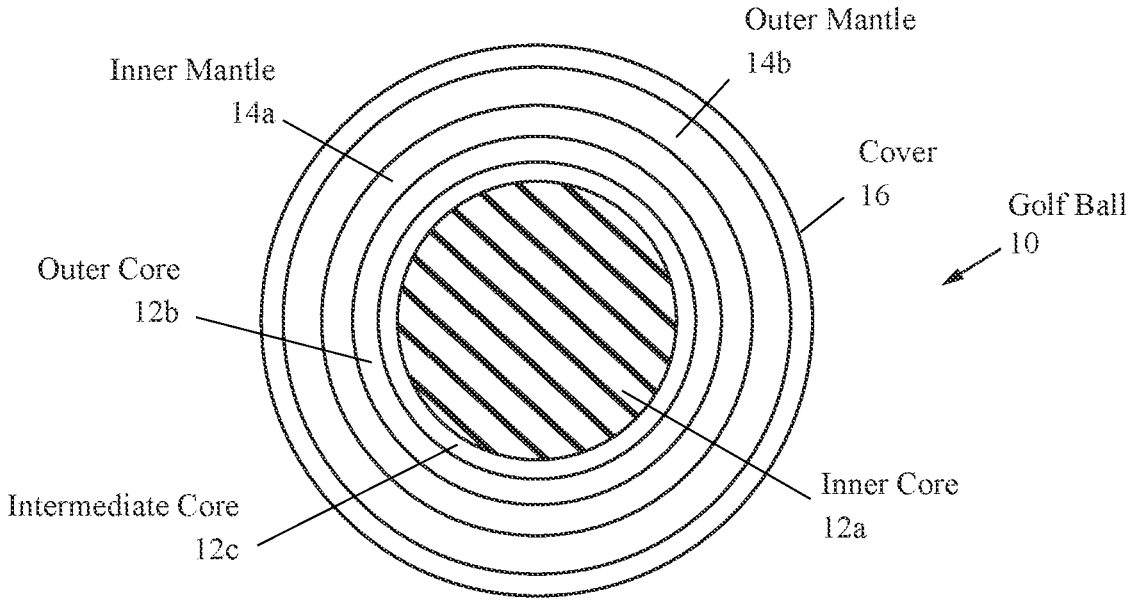
FIG. 16B is a cross-sectional view of a six-piece golf ball.

FIGS. 16A-16B illustrate a six piece golf ball 10 comprising an inner core 12*a*, an intermediate core 12*c*, an outer core 12*b*, an inner mantle 14*a*, an outer mantle 14*b*, and a cover 16, with an internal circuitry comprising at least a BLUETOOTH Low Energy radio ($5^{th}$ generation), a processor, a magnetometer, an accelerometer, and a battery. The internal circuit may also have a memory.

Figure 17:
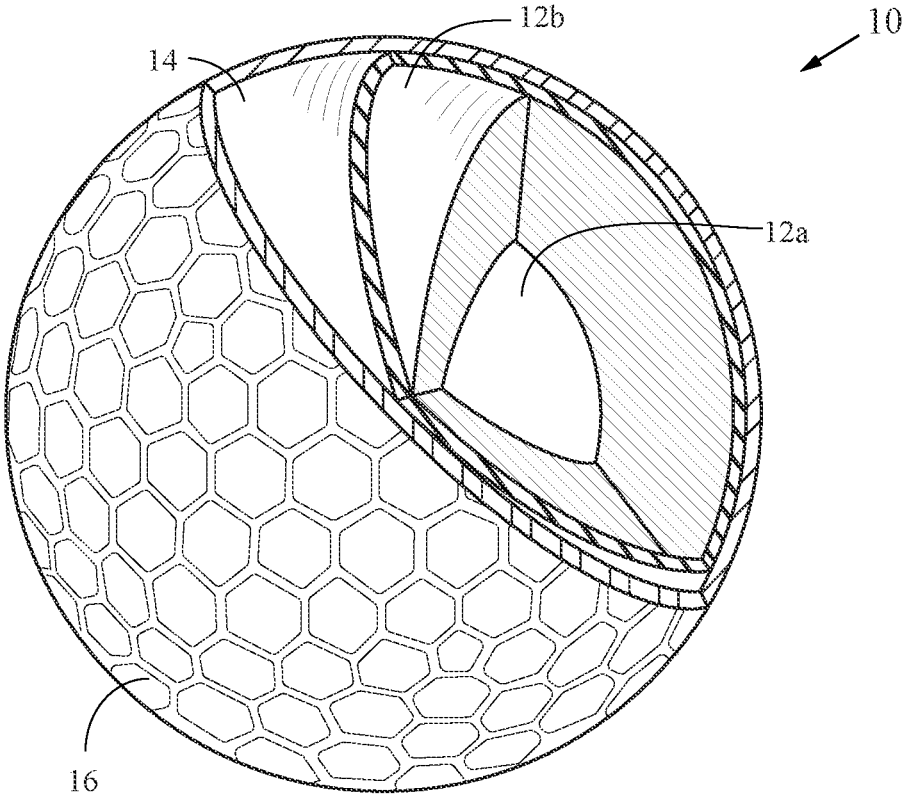
FIG. 17 is an exploded partial cut-away view of a four-piece dual core golf ball.

FIG. 17 illustrates a dual core four piece golf ball 10 comprising an inner core 12*a*, an outer core 12*b*, a mantle layer 14, and a cover 16, with an internal circuitry comprising at least a BLUETOOTH Low Energy radio ($5^{th}$ generation), a processor, a magnetometer, an accelerometer, and a battery. The internal circuit may also have a memory.

Figure 18:
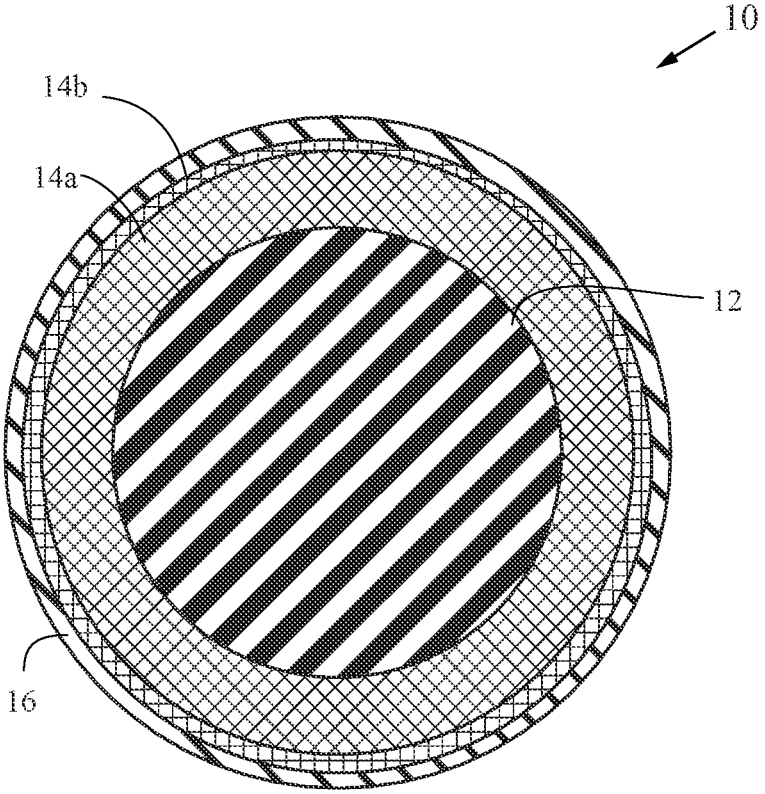
FIG. 18 is a cross-sectional view of a four-piece golf ball with a core, dual mantle layers and a cover.

FIG. 18 illustrates a four piece golf ball 10 comprising a core 12, an inner mantle 14*a*, an outer mantle 14*b* and a cover 16, with an internal circuitry comprising at least a BLUETOOTH Low Energy radio ($5^{th}$ generation), a processor, a magnetometer, an accelerometer, and a battery. The internal circuit may also have a memory.

Figure 19:
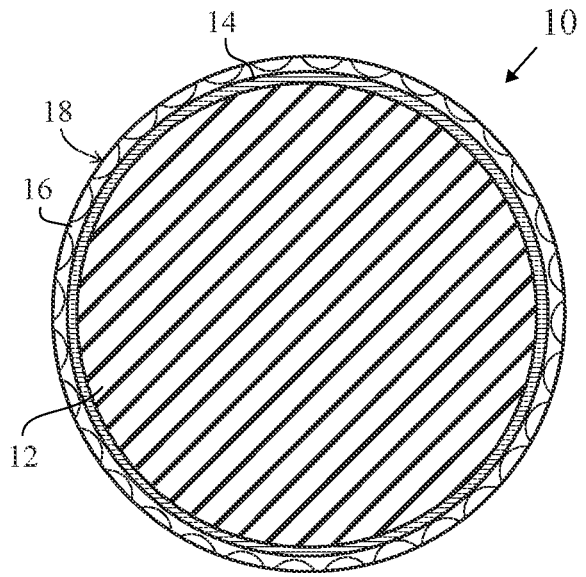
FIG. 19 is a cross-sectional view of a three-piece golf ball.
Figure 20:
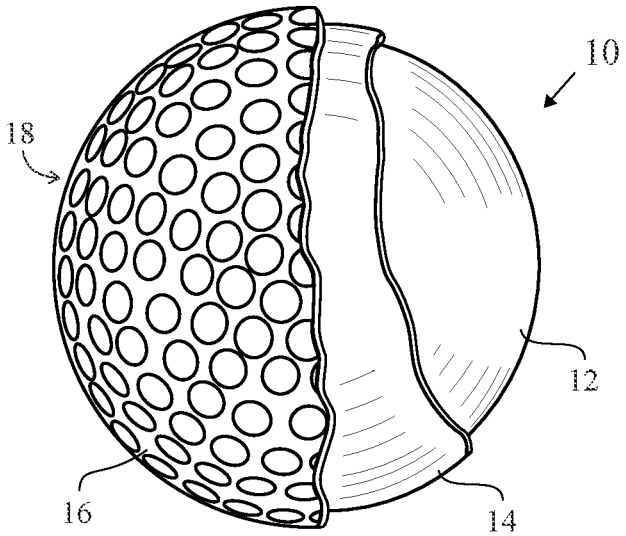
FIG. 20 is an exploded partial cut-away view of a three-piece golf ball.
Figure 21:
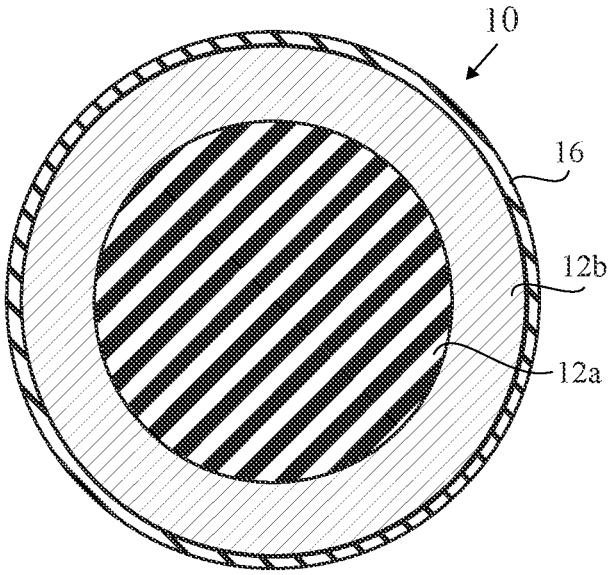
FIG. 21 is a cross-sectional view of a three-piece golf ball with a dual core and a cover.

FIGS. 19 and 20 illustrate a three-piece golf ball 10 comprising a core 12, a mantle layer 14 and a cover 16 with dimples 18, with an internal circuitry comprising at least a BLUETOOTH Low Energy radio ($5^{th}$ generation), a processor, a magnetometer, an accelerometer, and a battery. The internal circuit may also have a memory FIG. 21 illustrates a dual core three piece golf ball 10 comprising an inner core 12*a*, and outer core 12*b* and a cover 16, with an internal circuitry comprising at least a BLUETOOTH Low Energy radio ($5^{th}$ generation), a processor, a magnetometer, an accelerometer, and a battery. The internal circuit may also have a memory.

Figure 22:
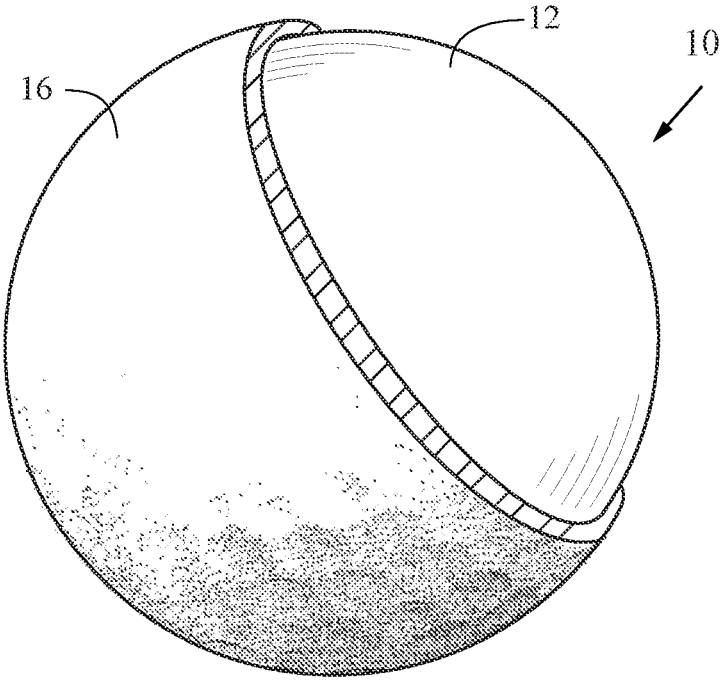
FIG. 22 is an exploded partial cut-away view of a two-piece golf ball.
Figure 23:
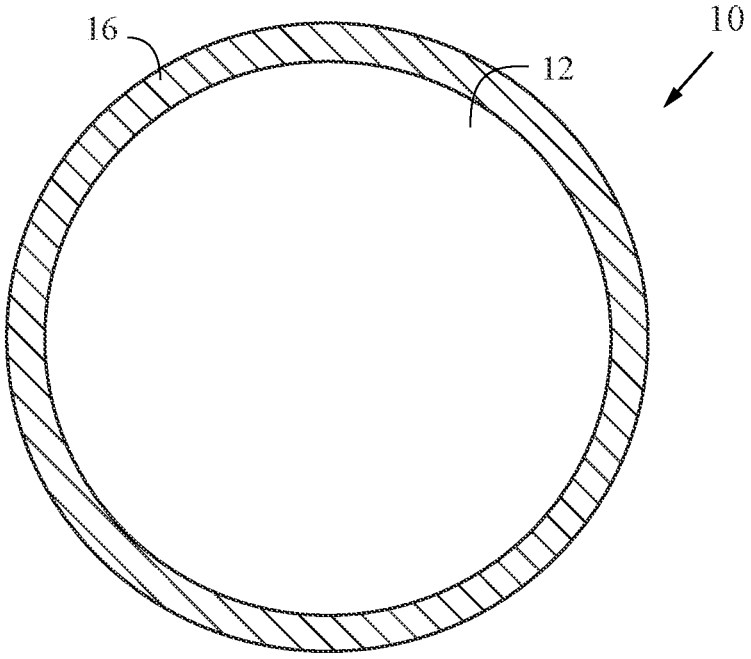
FIG. 23 is a cross-sectional view of a two-piece golf ball.

FIGS. 22 and 23 illustrate a two piece golf ball 10 with a core 12 and a cover 16 formed of a sprayed polyurea with a thickness ranging from 0.010 inch to 0.040 inch.

The mantle 14 component is preferably composed of the inner mantle layer 14*a* and the outer mantle layer 14*b*. The mantle component preferably has a thickness ranging from 0.05 inch to 0.15 inch, and more preferably from 0.06 inch to 0.08 inch. The outer mantle layer is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

In an alternative embodiment, the outer mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core, the inner mantle layer and the outer mantle layer preferably ranges from 38 grams to 43 grams, more preferably from 39 to 41 grams, and is most preferably approximately 41 grams.

The inner mantle layer is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer is alternatively composed of a HPF material available from DuPont. Alternatively, the inner mantle layer is composed of a material such as disclosed in Kennedy, III et al., U.S. Pat. No. 7,361,101 for a Golf Ball And Thermoplastic Material, which is hereby incorporated by reference in its entirety In an alternative embodiment, the inner mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer preferably ranges from 0.025 inch to 0.100 inch, and more preferably ranges from 0.070 inch to 0.090 inch.

In yet another embodiment, as shown in FIG. 18, wherein the inner mantle layer 14*a* is thicker than the outer mantle layer 14*b* and the outer mantle layer is harder than the inner mantle layer, the inner mantle layer is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer has a Shore D plaque hardness ranging preferably from 30 to 77, more preferably from 30 to 50, and most preferably approximately 40. In this embodiment, the material for the outer mantle layer has a Shore D plaque hardness ranging preferably from 40 to 77, more preferably from 50 to 71, and most preferably approximately 67. In this embodiment, the thickness of the inner mantle layer preferably ranges from 0.030 inch to 0.090 inch, and the thickness of the outer mantle layer ranges from 0.025 inch to 0.070 inch.

Preferably the inner core has a diameter ranging from 0.75 inch to 1.20 inches, more preferably from 0.85 inch to 1.05 inch, and most preferably approximately 0.95 inch. Preferably the inner core has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 14:
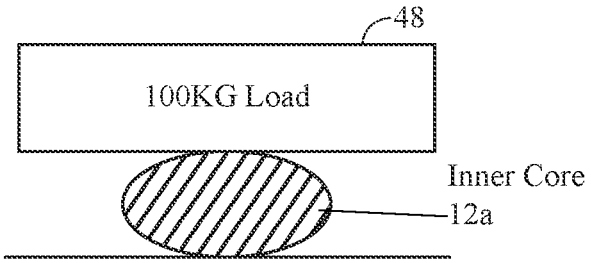
FIG. 14 is a cross-sectional view of an inner core layer under a 100 kilogram load.
Figure 15:
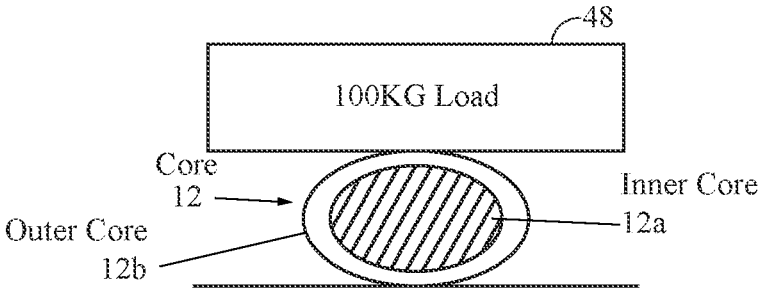
FIG. 15 is a cross-sectional view of a core under a 100 kilogram load.

Preferably the inner core has a deflection of at least 0.230 inch under a load of 220 pounds, and the core has a deflection of at least 0.080 inch under a load of 200 pounds. As shown in FIGS. 14 and 15, a mass 48 is loaded onto an inner core 12*a* and a core 12. As shown in FIGS. 14 and 15, the mass 48 is 100 kilograms, approximately 220 pounds. Under a load of 100 kilograms, the inner core preferably has a deflection from 0.230 inch to 0.300 inch. Under a load of 100 kilograms, preferably the core has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core ranges from 4 millimeters to 7 millimeters and more preferably from 5 millimeters to 6.5 millimeters. The dual core deflection differential allows for low spin off the tee to provide greater distance, and high spin on approach shots.

In an alternative embodiment of the golf ball shown in FIG. 13, the golf ball 10 comprises an inner core 12*a*, an intermediate core 12*c*, an outer core 12*b*, a mantle 14 and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

In one embodiment, the golf ball comprises a core, a mantle layer and a cover layer. The core comprises an inner core sphere, an intermediate core layer and an outer core layer. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer. The mantle layer is disposed over the core, comprises an ionomer material and has a Shore D hardness greater than 55. The cover layer is disposed over the mantle layer comprises a sprayed polyurea with a thickness ranging from 0.010 inch to 0.040 inch. The golf ball has a diameter of at least 1.68 inches. The mantle layer is harder than the outer core layer, the outer core layer is harder than the intermediate core layer, the intermediate core layer is harder than the inner core sphere, and the cover layer is softer than the mantle layer.

In another embodiment, shown in FIGS. 16A and 16B, the golf ball 10 has a multi-layer core and multi-layer mantle. The golf ball includes a core, a mantle component and a cover layer. The core comprises an inner core sphere, an intermediate core layer and an outer core layer. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer 12*b*. The inner mantle layer is disposed over the core, comprises an ionomer material and has a Shore D hardness greater than 55. The outer mantle layer is disposed over the inner mantle layer, comprises an ionomer material and has a Shore D hardness greater than 60. The cover layer is disposed over the mantle component, comprises a sprayed polyurea with a thickness ranging from 0.010 inch to 0.040 inch. The golf ball has a diameter of at least 1.68 inches. The outer mantle layer is harder than the inner mantle layer, the inner mantle layer is harder than the outer core layer, the outer core layer is harder than the intermediate core layer, the intermediate core layer is harder than the inner core sphere, and the cover layer is softer than the outer mantle layer.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers is measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the +5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

Bartels, U.S. Pat. No. 9,278,260, for a Low Compression Three-Piece Golf Ball With An Aerodynamic Drag Rise At High Speeds, is hereby incorporated by reference in its entirety.

Chavan et al, U.S. Pat. No. 9,789,366, for a Graphene Core For A Golf Ball, is hereby incorporated by reference in its entirety.

Chavan et al, U.S. Pat. No. 10,039,959, for a Graphene Core For A Golf Ball, is hereby incorporated by reference in its entirety.

Chavan et al, U.S. Pat. No. 10,058,741, for a Carbon Nanotubes Reinforced Dual Core A Golf Ball, is hereby incorporated by reference in its entirety.

Simonds et al., U.S. Pat. No. 9,707,454 for a Limited Flight Golf Ball With Embedded RFID Chip is hereby incorporated by reference in its entirety.

Simonds et al., U.S. Pat. No. 10,252,117 for a Graphene Core Golf Ball With An Integrated Circuit is hereby incorporated by reference in its entirety.

Balardeta et al., U.S. Pat. No. 8,355,869 for a Golf GPS Device is hereby incorporated by reference in its entirety.

Raposo, U.S. Pat. No. 8,992,346 for a Method And System For Swing Analysis is hereby incorporated by reference in its entirety.

Balardeta et al., U.S. Pat. No. 8,845,459 for a Method And System For Shot Tracking is hereby incorporated by reference in its entirety.

Raposo, U.S. patent application Ser. No. 16/157,998, filed on Oct. 11, 2018, for a Smart Golf Ball, is hereby incorporated by reference in its entirety.

Petrich et al., U.S. Pat. No. 10,688,366, for a Golf Ball With Electrical Components, is hereby incorporated by reference in its entirety.

Raposo et al., U.S. Pat. No. 11,344,785, for a Golf Ball With Electrical Components, is hereby incorporated by reference in its entirety.

Forsgren et al., U.S. Pat. No. 11,335,013 for Motion Based Pre-Processing Of Two Dimensional Image data Prior to Three Dimensional Object Tracking With Virtual Time Synchronization, is hereby incorporated by reference in its entirety.

Johansson et al., U.S. Pat. No. 10,898,757 for Three Dimensional Object Tracking Using Combination Of Radar Speed Data And Two Dimensional Image Data, is hereby incorporated by reference in its entirety.

Forsgren et al., U.S. Pat. No. 10,596,416 for a System And Method For Three Dimensional Object Tracking Using Combination Of Radar And Image Data, is hereby incorporated by reference in its entirety.

Forsgren et al., U.S. Pat. No. 8,077,917 for Systems And Methods For Enhancing Images In A Video Recording OF A Sports Event, is hereby incorporated by reference in its entirety.

Semsak et al., U.S. Pat. No. 10,799,770 for a RFID Golf Ball Testing Apparatus, is hereby incorporated by reference in its entirety.

Savarese et al., U.S. Pat. No. 9,592,424 for Apparatuses And Methods Relating To Findable Balls, is hereby incorporated by reference in its entirety.

Cheng, U.S. Pat. No. 8,342,951 for Providing Offers To Computers Game Players, is hereby incorporated by reference in its entirety.

Cheng, U.S. Pat. No. 7,847,808 for Photographic Mapping In A Simulation, is hereby incorporated by reference in its entirety.

Cheng, U.S. Pat. No. 7,806,777 for Automatically Adapting Virtual Equipment Model, is hereby incorporated by reference in its entirety.

Thirkettle et al., U.S. Pat. No. 7,337,965 for Ball Identifying Device, is hereby incorporated by reference in its entirety.

Thirkettle et al., U.S. Pat. No. 7,056,221 for Ball Collection Arrangement, is hereby incorporated by reference in its entirety.

Jollifee et al., U.S. Pat. No. 6,607,123 for Identifying Golf Balls, is hereby incorporated by reference in its entirety.

Burdette et al., U.S. Patent Publication Number 20220203178 for a Golf ball Dispenser With Embedded Display Device Separate Front Waterfall Panel And Or Blower Assembly is hereby incorporated by reference in its entirety.

Ericksson, U.S. Patent Publication Number 20220221572 for a Method For Determining Spin of A Projectile is hereby incorporated by reference in its entirety.

Forsgren et al., U.S. Patent Publication Number 20220138969 for Three-dimensional object tracking using unverified detections registered by one or more sensors, is hereby incorporated by reference in its entirety.

Forsgren et al., U.S. Patent Publication Number 20220051420 for Motion Based Pre-Processing of Two-Dimensional Image Data Prior to Three-Dimensional Object Tracking With Virtual Time Synchronization, is hereby incorporated by reference in its entirety.

Stroud, U.S. patent application Ser. No. 18/208,164, filed on Jun. 9, 2023, for a Method And System Utilizing A Golf Shot API Proxy, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. An entertainment venue comprising:

a plurality of targets positioned in an outfield of the entertainment venue, each of the plurality of targets comprising at least one receiver;

a plurality of hitting bays, each of the plurality of hitting bays comprising a golf ball dispenser and a graphical display unit;

a plurality of golf balls, each of the plurality of golf balls comprising a piezoelectric material connected to a computational device comprising a processor, an accelerometer, a gyroscope, a magnetometer, a battery and a wireless transmitter;

wherein the piezoelectric material is activated when the golf ball is struck by a player which causes the battery to power the computational device to generate ball content including an identification of the golf ball, and instructs the wireless transmitter to transmit a data signal which is read by the at least one receiver, wherein the at least one receiver transmits the ball content of the data signal to a database for analysis and display on graphical display unit in the hitting bay where the golf ball originated.

* * * * *